US011155947B2

(12) United States Patent
Kiefer et al.

(10) Patent No.: US 11,155,947 B2
(45) Date of Patent: Oct. 26, 2021

(54) BRAIDED CONSTRUCT AND METHOD OF MAKING THE SAME

(71) Applicant: Lake Region Medical, Inc., Wilmington, MA (US)

(72) Inventors: Robert A. Kiefer, Quakertown, PA (US); Nathan Spangenberg, Quakertown, PA (US)

(73) Assignee: Lake Region Manufacturing, Inc., Chaska, MN (US)

( * ) Notice: Subject to any disclaimer, the term of this patent is extended or adjusted under 35 U.S.C. 154(b) by 0 days.

(21) Appl. No.: 16/609,608

(22) PCT Filed: May 2, 2018

(86) PCT No.: PCT/US2018/030746
§ 371 (c)(1),
(2) Date: Oct. 30, 2019

(87) PCT Pub. No.: WO2018/204553
PCT Pub. Date: Nov. 8, 2018

(65) Prior Publication Data

US 2020/0056312 A1 Feb. 20, 2020

Related U.S. Application Data

(60) Provisional application No. 62/500,200, filed on May 2, 2017.

(51) Int. Cl.
*D04C 1/12* (2006.01)
*D04C 3/18* (2006.01)
(Continued)

(52) U.S. Cl.
CPC ..... *D04C 1/12* (2013.01); *D04C 3/18* (2013.01); *D04C 3/30* (2013.01); *D07B 1/185* (2013.01);
(Continued)

(58) Field of Classification Search
CPC ... D04C 1/12; D04C 3/18; D04C 3/30; D07B 1/185; D07B 2201/1096; D10B 2403/0333; D10B 2509/04
See application file for complete search history.

(56) References Cited

U.S. PATENT DOCUMENTS 487,149 A * 11/1892 Krouse et al. ..... A41F 9/002 2/338
2,879,687 A * 3/1959 Leimbach ..... D04C 3/22 87/37
(Continued)

FOREIGN PATENT DOCUMENTS

EP 2508661 A2 10/2012
GB 1463760 A 2/1977
(Continued)

OTHER PUBLICATIONS

"Extended European Search Report, Application No. 18794738.7, dated Feb. 19, 2021".
(Continued)

*Primary Examiner* — Shaun R Hurley
(74) *Attorney, Agent, or Firm* — Michael F. Scalise

(57) ABSTRACT

Methods and systems for braiding sutures and the resulting constructs are disclosed. The sutures can have alternating bifurcated and non-bifurcated lengths. The sutures can have looped-ends, with both ends of the loop having contiguous braiding with the adjacent body or remainder of the suture. Braiding machines can have one or more bifurcating bars that can controllably obstruct or allow passage of the shuttle and carriers of the braiding machine. The controllable bifurcating bars can result in u-turns in the shuttle and carrier paths, such as a path encircling a horngear adjacent to the bifurcating bar, or passage of the shuttle and carrier across the bifurcating bar.

18 Claims, 31 Drawing Sheets

(51) Int. Cl.
*D04C 3/30* (2006.01)
*D07B 1/18* (2006.01)

(52) U.S. Cl.
CPC .. *D07B 2201/1096* (2013.01); *D10B 2509/04* (2013.01)

(56) References Cited

U.S. PATENT DOCUMENTS 3,932,697 A * 1/1976 Hood ..... D07B 1/185 174/79
4,719,837 A * 1/1988 McConnell ..... D04C 3/12 87/1
4,917,699 A * 4/1990 Chervitz ..... A61F 2/08 623/13.19
5,287,790 A * 2/1994 Akiyama ..... B29C 70/16 87/11
5,361,674 A 11/1994 Akiyama et al.
6,907,810 B2 * 6/2005 Kim ..... D04C 3/12 87/16
7,908,956 B2 * 3/2011 Dow ..... H04N 21/23424 87/16
8,347,772 B2 * 1/2013 Dow ..... D04C 1/06 87/41
8,713,905 B1 * 5/2014 Branscomb ..... D07B 7/18 57/22
8,794,118 B2 * 8/2014 Dow ..... D04C 1/00 87/41
8,955,299 B2 * 2/2015 Stout ..... D07B 7/18 57/202
9,038,520 B2 * 5/2015 Kang ..... F16F 1/366 87/9
9,610,077 B2 * 4/2017 Allen ..... D04C 1/12
2004/0094024 A1 * 5/2004 Kim ..... D04C 1/12 87/6
2010/0298872 A1 * 11/2010 Berndt ..... A61B 17/06166 606/228
2011/0203446 A1 * 8/2011 Dow ..... D04C 1/06 87/11
2012/0024134 A1 2/2012 Dow et al.
2012/0297745 A1 * 11/2012 Stout ..... D07B 7/18 57/202
2012/0330353 A1 * 12/2012 Yoo ..... A61B 17/06166 606/224
2013/0167710 A1 * 7/2013 Dow ..... D04C 3/30 87/9
2013/0204354 A1 8/2013 Adams
2014/0172096 A1 * 6/2014 Koob ..... D04C 1/12 623/13.19
2015/0045831 A1 2/2015 Allen

FOREIGN PATENT DOCUMENTS

WO 2012121986 A2 9/2012
WO 2012121986 A3 9/2012

OTHER PUBLICATIONS

Notification of Transmittal of the International Search Report and Written Opinion, PCT/US18/30746, dated Sep. 18, 2018.

* cited by examiner

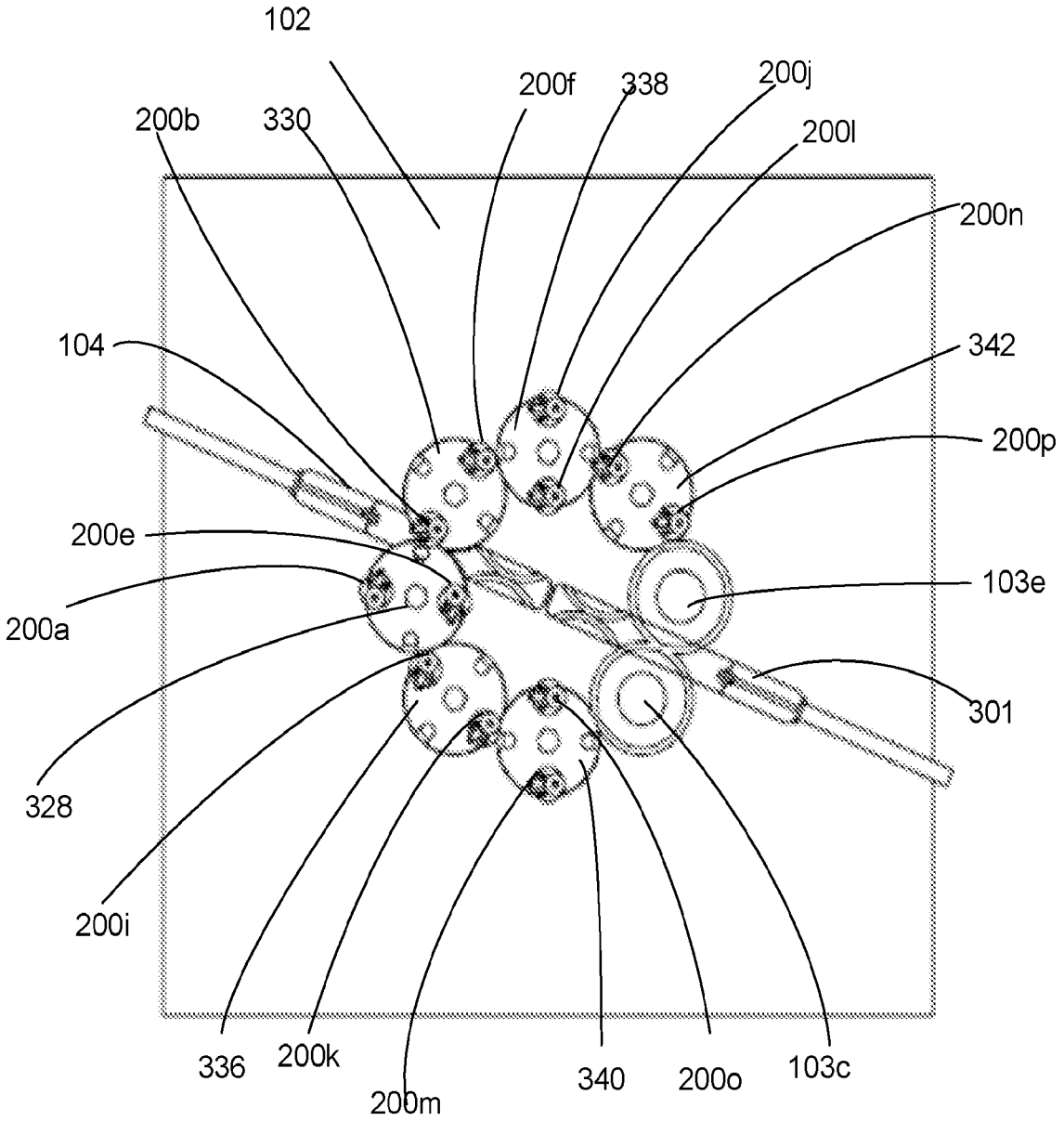
FIG. 4
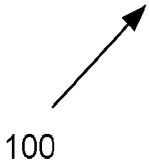

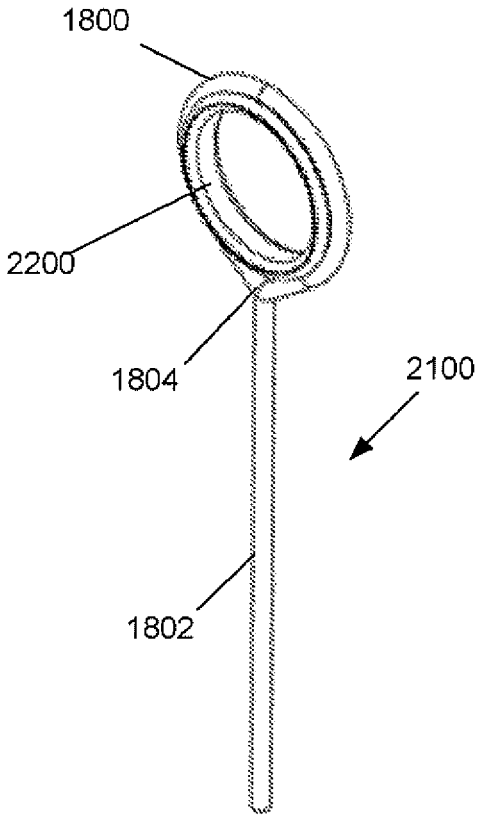
FIG. 22A
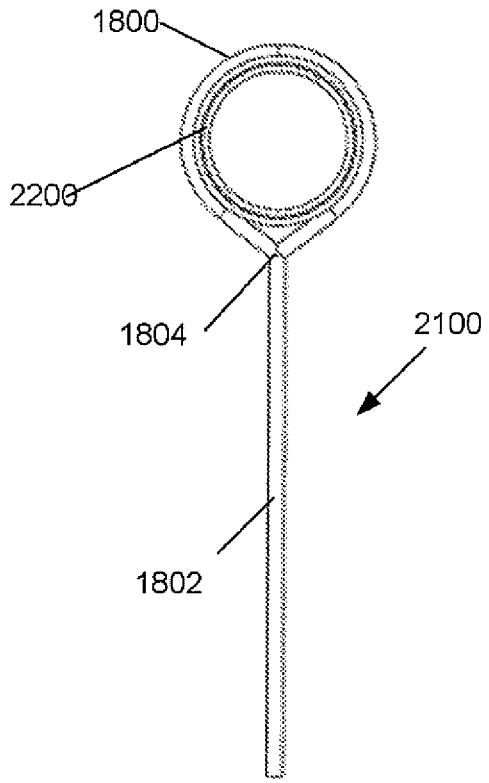
FIG. 22B
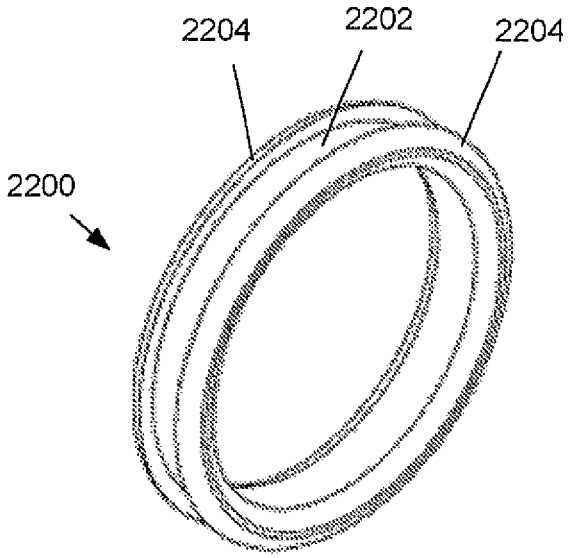

BRAIDED CONSTRUCT AND METHOD OF MAKING THE SAME

CROSS-REFERENCE TO RELATED APPLICATION

This application claims priority to U.S. Provisional Application No. 62/500,200, filed May 2, 2017, which is incorporated by reference herein in its entirety.

BACKGROUND

Braiding machines have been used to create braided sutures, traditionally in a maypole fashion. Some braiding machines allow for bifurcating of sutures. In order to do so, the braiding machine must be stopped, an obstructing bar that completely blocks entire horngears' paths is then bolted to the braiding machine, and then the braiding machine is restarted. The same must be done in reverse to stop the bifurcating of the suture.

A closed-loop braided textile, and methods and systems for making the closed-loop braided textile are disclosed. Certain medical applications desire a flexible textile component, such as a suture, that has a loop on the distal end of component. This loop can be used to hook onto a medical device or a device component to position the device in vivo or can be used to remove a device or component if the delivery position is not correct. Closed looped constructs have other uses such as a load transfer member in surgical instrumentation, a load transfer member as a standalone or as a component of an implantable class 2 or class 3 medical devices.

These looped-end sutures are often made by braiding a single suture length, and then looping a first terminal end of the suture back and feeding it through the side of the suture, between yarns, and into a lumen in a center lumen of the suture, pointing the direction of the opposite (i.e., second) end of the suture. If a long enough segment of the first terminal end is fed through the lumen, the hope is that during use, when a longitudinal tension is applied to the suture, that the braid of the suture will constrict upon the first terminal end—which has been fed back into the lumen of the suture—with sufficient frictional force to keep it in place despite the tension pulling on the loop.

Accordingly, improved systems and methods for bifurcating lengths of sutures are desired. Furthermore, improved methods and structures for forming looped-end sutures are desired.

SUMMARY

A method for making a braided textile suture is disclosed. The method can include loading a braiding machine with a first yarn in a first carrier and a second yarn in a second carrier. The method can include attaching the first yarn to the second yarn into a first combined yarn. The attaching the first yarn to the second yarn can be at a first attachment point. The attaching can include tying, welding, epoxying, gluing, clipping, or combinations thereof, the first yarn to the second yarn. The method can include pulling the first attachment point to the first carrier. The method can include placing the first combined yarn on a collector, such as an S-hook. The method can include maypole braiding the first combined yarn on a first side of the collector. The method can include maypole braiding the first combined yarn on a second side of the collector separate from the maypole braiding of the first combined yarn on the first side of the collector.

The method can also include maypole braiding the first and second yarns on both sides of the collector together in a single maypole. Before the maypole braiding of the first and second yarns on both sides of the collector together in a single maypole, the method can also include changing a carrier gate, such as a bifurcation bar having closed and open gates, from a closed configuration to an open configuration.

The maypole braiding of the first combined yarn on a second side of the collector separate from the maypole braiding of the first combined yarn on the first side of the collector can be concurrent with the maypole braiding of the first combined yarn on the first side of the collector.

Pulling of the first attachment point to the first carrier can include burying the first attachment point in yarn on the first carrier, such as winding the first attachment point into the yarn on a bobbin on the carrier.

The maypole braiding of the first combined yarn on both sides of the collector together in a single maypole can be after the maypole braiding of the first combined yarn on a second side of the collector separate from the maypole braiding of the first combined yarn on a first side of the collector.

The first carrier can be positioned opposite to the second carrier with respect to the braiding machine. The first carrier and the second carrier can rotate around the braiding machine in the same direction.

The method can include loading the braiding machine with a third yarn in a third carrier, and a fourth yarn in a fourth carrier. The method can include attaching the third yarn to the fourth yarn into a second combined yarn. The attaching the third yarn to the fourth yarn can be done at a second attachment point. The method can include pulling the second attachment point to the third carrier. The method can include placing the second combined yarn on the collector. The maypole braiding of the first combined yarn on a first side of the collector can include maypole braiding the first combined yarn with the second combined yarn on the first side of the collector.

The maypole braiding of the first combined yarn on a second side of the collector can include maypole braiding the first combined yarn with the second combined yarn on the second side of the collector separate from the maypole braiding of the first combined yarn on the first side of the collector.

The method can include loading the braiding machine with a third yarn. The maypole braiding of the first combined yarn on a first side of the collector can include maypole braiding the first combined yarn with the third yarn on the first side of the collector.

A method for making a braided textile suture is disclosed. The method can include loading a first yarn on a first carrier and a second yarn in a maypole braiding machine. The method can include attaching the first yarn to the second yarn at an attachment point. The attached first and second yarns can form a combined first yarn. The method can include burying the first attachment point in the first carrier. The method can include operating the maypole braiding machine to produce a bifurcated braid. The bifurcated braid can include the combined first yarn. The method can include then altering the maypole braiding machine to produce a non-bifurcated braid extending continuously from the bifurcated braid. The non-bifurcated braid can include the combined first yarn.

Altering the maypole braiding machine can include moving a gate from a closed configuration to an open configuration, such as sliding a bifurcation bar from a closed configuration to an open configuration.

A braided textile suture is disclosed. The suture can have a closed loop having a convergence point, a tail extending from the convergence point, a first yarn, and a second yarn. The first yarn and second yarn can extend continuously from the tail into a first side of the closed loop. The first and second yarns can extend continuously through the closed loop. The first and second yarns can extend from a second side of the closed loop into and along the tail. The first and second yarns in the tail extending from both sides of the closed loop can be braided in a single maypole in the tail. The first and second yarns can be made from a polymer.

A braided textile suture is disclosed that can have a tail, and a closed loop having a first end and a second end. The first and second ends can converge at the tail. An end of the tail adjacent to the closed loop can be a single maypole braid. The first and second ends of the closed loop can be continuously maypole braided into the tail.

The suture can have yarns continuously extending from the tail into the first end of the closed loop, through the second end of the closed loop and back into the tail. The suture can have yarns in the closed loop and the tail, and more than half of the yarns in the closed loop can extend into the single maypole braid of the tail.

A system and method for making a braided textile is disclosed. The method can include braiding the textile with a braider. The braider can have a first horngear, a second horngear and a first shuttle and a second shuttle. The first horngear can be a horngear immediately adjacent to the second horngear. The first horngear can have a first horngear axis and the second horngear can have a second horngear axis, about which the respective horngears rotate.

The method can include positioning a bifurcation first bar in an obstructing or bifurcating configuration between the first horngear axis and the second horngear axis. The method can include moving the first shuttle when the bifurcation first bar is in the first configuration, and this moving can include the first shuttle moving toward the first horngear along a path of the first horngear, and then against a first side of the bifurcation first bar, and then out of the first horngear away from the second horngear.

The method can also include moving the second shuttle when the bifurcation first bar is in the bifurcating configuration, and this moving can include moving the second shuttle toward the second horngear along a path of the second horngear, then against a second side of the bifurcation first bar, and then out of the second shuttle away from the first horngear.

The method can also include sliding the bifurcation first bar along a longitudinal axis of the bifurcation first bar to an open or non-bifurcating configuration.

The method can also include positioning the bifurcation first bar in the open or non-bifurcating configuration. The method can include moving the first shuttle when the bifurcation first bar is in the open configuration, this moving can include moving the first shuttle along a path of the first horngear toward the second horngear, and then moving the first shuttle immediately to the second horngear.

The method can include moving the second shuttle when the bifurcation first bar is in the open configuration, this moving can include moving the second shuttle along a path of the second horngear toward the first horngear, and then moving the second shuttle immediately to the first horngear.

The method can include positioning the bifurcation first bar in the open configuration. The positioning of the bifurcation first bar can include indexing the position of the bifurcation first bar with at least an indexing pin extending from a braider top plate.

The braider can have a third horngear, a fourth horngear, and a third shuttle. The method can include moving the third shuttle when the bifurcation second bar is in a bifurcating configuration, and this moving can include moving the third shuttle toward the fourth horngear along a path of the third horngear, then against a first side of the bifurcation second bar, and then out of the third shuttle away from the fourth horngear. The method can also include moving the third shuttle when the bifurcation second bar is in an open configuration, this moving can include moving the third shuttle along a path of the third horngear toward the fourth horngear, and then moving the third shuttle immediately to the fourth horngear.

The braider further can include the third horngear, fourth horngear, third shuttle, and a bifurcation second bar having an obstructing or bifurcating configuration and an open or non-bifurcating configuration. The method can include moving the third shuttle when the bifurcation second bar is in the bifurcating configuration, and this moving can include moving the third shuttle toward the fourth horngear along a path of the third horngear, then against a first side of a bifurcation second bar, and then out of the third shuttle away from the fourth horngear. The method can also include moving the third shuttle when the bifurcation second bar is in the open configuration, and this moving can include moving the third shuttle along a path of the third horngear toward the fourth horngear, and then moving the third shuttle immediately to the fourth horngear.

The bifurcation first bar can have a shuttle return track allowing for motion of the shuttles into a first lateral side of the bifurcation first bar and then out of the first lateral side of the bifurcation first bar without exiting a second lateral side of the bifurcation first bar. The bifurcation second bar can have a shuttle return track allowing for motion of the shuttles into a first lateral side of the bifurcation second bar and then out of the first lateral side of the bifurcation second bar without exiting a second lateral side of the bifurcation second bar.

The bifurcation first bar can have a shuttle through track allowing for motion of the shuttles from a first lateral side of the bifurcation first bar to a second lateral side of the bifurcation first bar. The bifurcation second bar can have a shuttle through track allowing for motion of the shuttles from a first lateral side of the bifurcation second bar to a second lateral side of the bifurcation second bar.

Also disclosed is a method for making a braided textile that can include moving carriers with horngears along carrier paths in a braiding machine having an obstructing element having an obstructing configuration and an open or non-obstructing configuration. The method can include dividing the braiding machine with the obstructing element in the obstructing configuration into at least a first portion and a second portion. The method can include obstructing the carrier paths from extending from the first portion into the second portion. The obstructing can include obstructing with the obstructing element in the obstructing configuration. When the carrier paths are obstructed, the carrier paths in the first portion can encircle a first horngear, and the carrier paths in the second portion can encircle a second horngear. The first horngear can be an immediately adjacent horngear to the second horngear.

The method can also include allowing the carrier paths to extend from the first portion into the second portion when the obstructing element is in the open configuration.

The method can include indexing the obstructing element between the obstructing configuration of the obstructing element and the open configuration of the obstructing element.

The method can include moving the obstructing element from the obstructing configuration to the open configuration, and this moving can include sliding the obstructing element within a slot in a carrier top plate of the braiding machine.

The method can include producing a braided textile with a looped end contiguous with a single maypole braid suture tail.

Further disclosed is a method for making a braided textile that can include braiding a textile with a braiding machine. The braiding machine can have a first horngear, a second horngear, and a third horngear on the opposite side of the second horngear from the first horngear, an obstructing bar, and a first carrier. The obstructing bar can have at least an obstructing position and an open or non-obstructing position. The method can include braiding that can include moving the first carrier from the second horngear immediately to the first horngear when the obstructing bar is in the obstructing position. The method can include sliding the obstructing bar along a longitudinal axis of the obstructing bar from the obstructing position to the open position. The braiding can include moving the first carrier from the second horngear immediately to the third horngear when the obstructing bar is in the open position.

The sliding can include indexing the obstruction bar. The indexing of the obstruction bar can include at least sliding an indexing pin in an indexing slot. The sliding can include moving the obstruction bar with an electromechanical actuator. The method can include sliding the obstruction bar from the open position to the obstructing position. The sliding can include translating the obstructing bar within a bar track in a top plate of the braiding machine. The method can include producing a braided textile with a looped end contiguous with a single maypole braid suture tail.

A method of making a braided textile having a distal end including a closed loop of an interbraided braid and a proximal end including a tail is disclosed. The method can include setting a braiding machine to a bifurcation braiding configuration. The method can include selecting a holder. The method can include placing one yarn end in a carrier on one side of the machine and placing a second yarn end in a second carrier on an opposing side of the machine. The carriers can move in the same direction (i.e., clockwise or counterclockwise). The method can include tying the yarn ends together. The method can include optionally repeating placing yarn on opposing sides of the machine and tying the yarn ends together, for example, from 1 to 5 times. The method can include braiding in a bifurcation braiding configuration until the braided braid is long enough to encircle the holder. The method can include stopping the braiding machine and switching the braiding machine to a maypole braiding configuration. The method can include then braiding in a maypole braiding configuration until a desired length of a tail of the braided textile has been formed.

The holder may be, for example, an S-hook style mandrel. The closed-loop of the braided textile can be braided around the holder. The outer diameter of the holder can be or correlate with the final inner diameter of the closed loop.

A method of weaving or braiding the braided textile is disclosed. The method can include that braider bobbins can be wound with a desired size of yarn and pulled into each of the carriers on the machine. The braider can be set to a bifurcation braiding configuration and the carriers can be evenly split with half of the carriers on each side of the machine. A yarn from a carrier on each side can be tied together using a standard knot. The carrier yarns that are tied together can be moving in the same radial direction on the machine. Each yarn bundle can be placed on the collector hook. The braiding machine, for example rotating of the horngears, can then be started.

The diameter of the closed loop of the braided textile can be defined by the operators input for pick count (i.e., a measure of density of a braid) in bifurcation braiding configuration. When the desired pick count is reached, the machine can be converted over to standard single maypole braiding. This is controlled by moving electromechanical or pneumatically actuated gates, for example to slide the bifurcation bars, in the top plate and/or within the braider bed. The braiding machine can then begin braiding the tail section of the braided textile with the length being defined by the HM I setting ("human machine interface," for example performed via a programmable linear controller) for picks for the tail feature. When the final pick count is reached, the machine can turn off automatically and can position the carriers in the bifurcation position. The operator can then resets the machine by cutting two yarn ends and tying them together. This process can be repeated until all the carrier yarns are tied off. The braider can be a 16 carrier braiding machine with 8 carriers being utilized.

BRIEF DESCRIPTION OF THE DRAWINGS

FIG. 4 is a top view of a variation of the braiding machine.

FIGS. 22A and 22B are perspective and side views of a variation of a braided closed loop textile having a reinforcement grommet.

FIG. 23 is a perspective view of a variation of the reinforcement grommet.

DETAILED DESCRIPTION

A braiding machine or braider 100 and a method of making a braided textile, such as a suture, having a distal end and a proximal end using the braiding machine are disclosed.

Figure 1A:
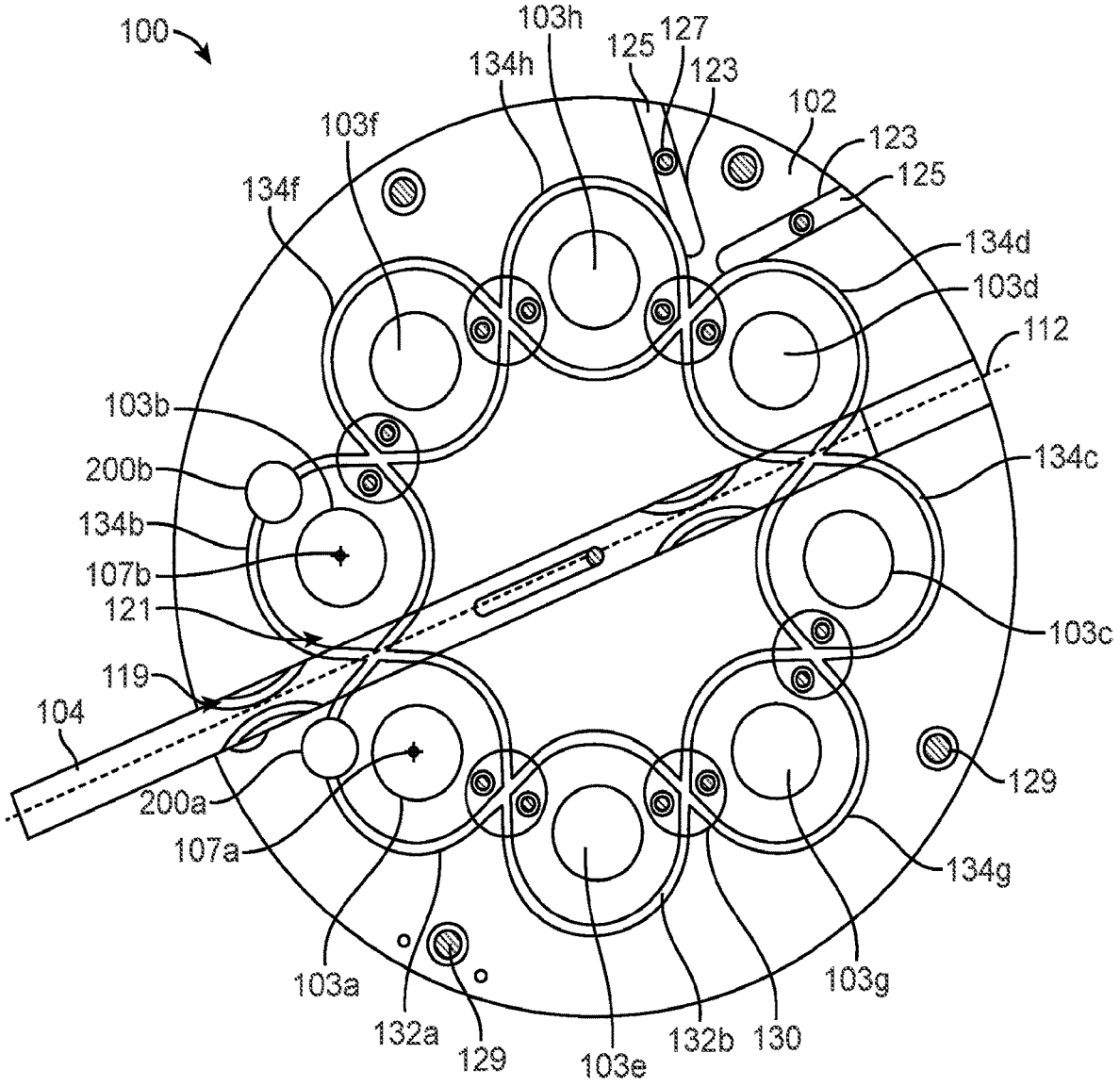
FIG. 1A is a top view of a braider top plate of a braiding machine in a second configuration.
Figure 1B:
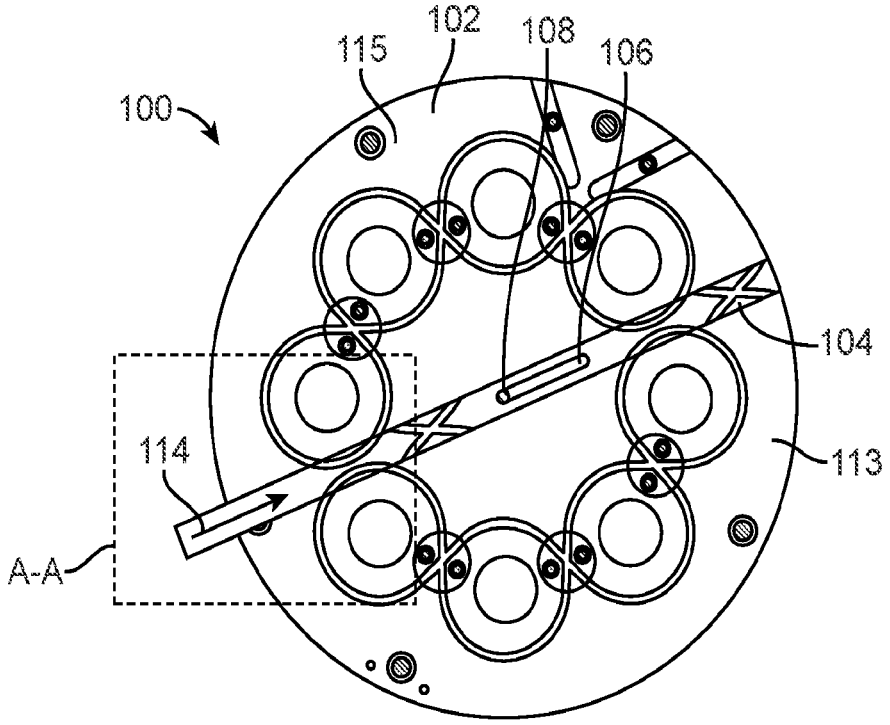
FIG. 1B is a top view of the braider top plate of the braiding machine in a first configuration.
Figure 1C:
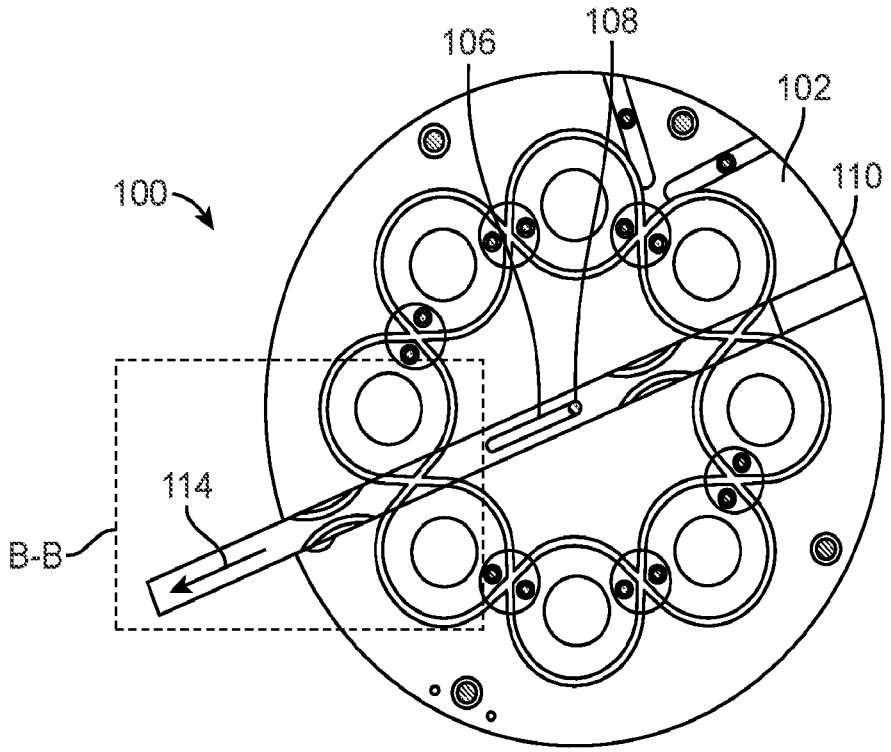
FIG. 1C is a top view of the braider top plate of the braiding machine in the first configuration.

FIGS. 1A-1C illustrate that the braider 100 can have a braider top plate 102 with an obstructing or bifurcation rod or bar 104. The bifurcation bar 104 can have a bifurcation bar longitudinal axis 112 across the braider top plate 102 that can divide the braider top plate 102 into a first portion 113 and a second portion 115. More than one bifurcation bar can be used to divide the braider top plate into more than two portions. The braider 100 can have one or more horngears 103, such as first through eighth horngears 103*a*-103*h*. The horngears 103 can be below the top plate 102. Each horngear 103 can rotate around a respective horngear axis 107, such as first and second horngear axes 107*a* and 107*b*.

The braider 100 can have one or more carriers 200, such as first through sixteenth carriers 200*a*-200*p*. The braiders 100 can each carry one or more yarns, for example on a spool or bobbin rotatably carried on a bobbin axle 131 on the carrier 200. The yarns can be braided into the braided textile.

The top plate 102 can have a carrier tracks 132, such as intersecting first and second carrier tracks 132*a* and 132*b*. The carriers 200 can slide through the carrier tracks 132. The carriers 200 can be placed in the carrier tracks 132 and slide in a 1-over-1 configuration (i.e., a carriers alternating passing each other in opposite directions on the carrier tracks), 1-over-2-by-2 (also known as 1-over-2) configuration, 2-over-2 configuration (i.e., pairs of carriers alternating passing each other in opposite directions on the carrier tracks), or combinations thereof. The carrier tracks 132 encircling each horngear 103 can be horngear paths, for example first through eighth horngear paths 134*a*-*h*, for the first through eighth horngears 103*a*-*h*, respectively.

Each carrier 120 can be pushed and driven through the carrier track 132 by the closest horngear 103.

The bifurcation bar 104 can have one or more switching gates 119 and transfer gates 121. The gates can have track through which the carriers 200 can slide. The transfer gates 121 can allow the carrier 200 to pass from a first lateral side of the bifurcation bar 104 to a second lateral side of the bifurcation bar 104. The switching gates 119 can return the carrier 200 from the same lateral side of the bifurcation bar 104 from which the carrier 200 entered the switching gate 119.

The top plate 102 can have one or more loading slots 123 and loading locks 125 in the loading slots 123. The loading locks 125 can be attached and detached from the braider 100 by loading lock bolts 127. When the loading slots 123 are open (e.g., the loading locks 125 are not in the loading slots), the carriers 200 can be loaded into and/or unloaded from the carrier tracks 132.

The top plate 102 can be attached to a chassis or frame of the braider 100 with top plate mounting bolts 129.

The braider 100 can have embedded gates 130. The embedded gates 130 can be inserted into holes or divots in the top of the top plate 102 and bolted to the top plate 102. The top surface of the embedded gates 130 can be flush with the top surface of the top plate 102. The embedded gates 130 can have tracks aligned with the carrier tracks 132 to act as transfer gates and allow the carriers to pass through the embedded gates 130. The embedded gates 130 can be rotated (e.g., at 90 degrees) compared to shown in FIGS. 1A-1C to block the path of the carrier tracks 132 and obstruct the path of the carriers 130, for example blocking the carriers 200 and acting as switching gates.

FIG. 1B illustrates that the bifurcation bar 104 can be in a closed, bifurcated, obstructed or return configuration or position. Sliding the bifurcation bar 104 in a first direction 114 in the bifurcation bar track 110 along the bifurcation bar longitudinal axis 112 can translate the bifurcation bar from an open configuration to the obstructed configuration.

FIG. 1C illustrates that the bifurcation bar 104 can be in the open, transfer, or unobstructed configuration. For example, the bifurcation bar 104 can be slid in a second direction 117 in the bifurcation bar track 110 along the bifurcation bar longitudinal axis 112.

The braider 100 can have an indexing pin 108. The indexing pin 108 can be fixed with respect to the top plate 102. The bifurcation bar 104 can have an indexing slot 106 along a length of the bifurcation bar longitudinal axis 112. The indexing pin 108 can extend through the indexing slot 106. The bifurcation bar 104 can be slidable along the indexing pin 108 in the first direction 114 and the second direction 117. When the indexing pin 104 is at a first terminal longitudinal end of the indexing slot, the bifurcation bar 104 can be in the closed configuration. When the indexing pin 104 is at a second terminal longitudinal end of the indexing slot, the bifurcation bar 104 can be in the open configuration.

Figure 2A:
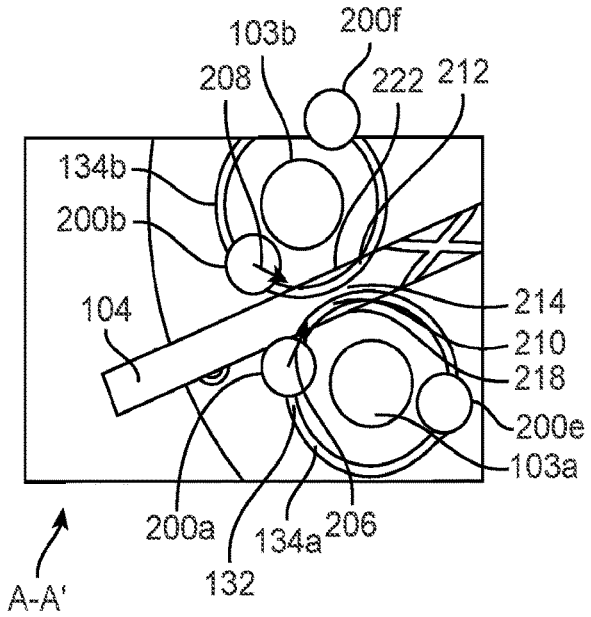
FIG. 2A is an A-A' view of FIG. 1B with carriers shown in a first position when the braiding machine is in the first configuration.
Figure 2B:
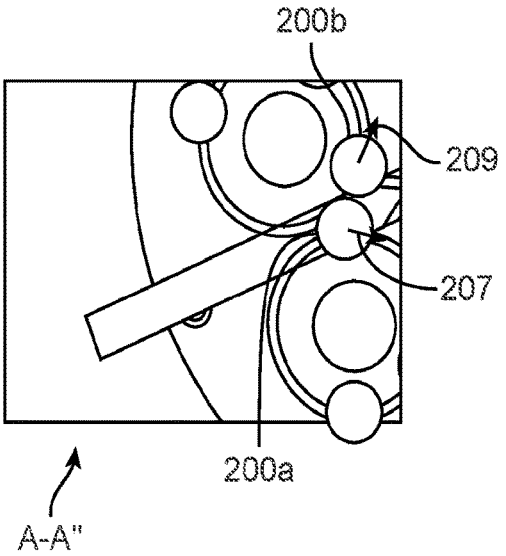
FIG. 2B is a A-A" view of FIG. 1B with carriers shown in a second position when the braiding machine is in the first configuration.

FIGS. 2A and 2B illustrate that when the bifurcation bar 104 is in the closed configuration, a first carrier 200*a* can move along the first horngear path 132 (or first carrier path) in a first carrier translation first direction 206 toward the second horngear 103*b* and then can move against a first side 218 of the bifurcation bar 104 along a first bifurcated path 210 (or channel or shuttle track) and then back on the first horngear path 132 in a first carrier translation second direction 207 away from the second horngear 103*b*. Similarly, a second carrier 200*b* and a second shuttle 352 coupled to the second carrier 200*b* can move along the second horngear path 134*b* (or second carrier path) in a second carrier translation first direction 208 toward the first horngear 103*a* and then move against a second side 222 of the bifurcation bar 104 along a second bifurcated path 212 (or channel or shuttle track) and then back on the second horngear path 134*b* in a second carrier translation second direction 209 away from the first horngear 103*a*.

Figure 2C:
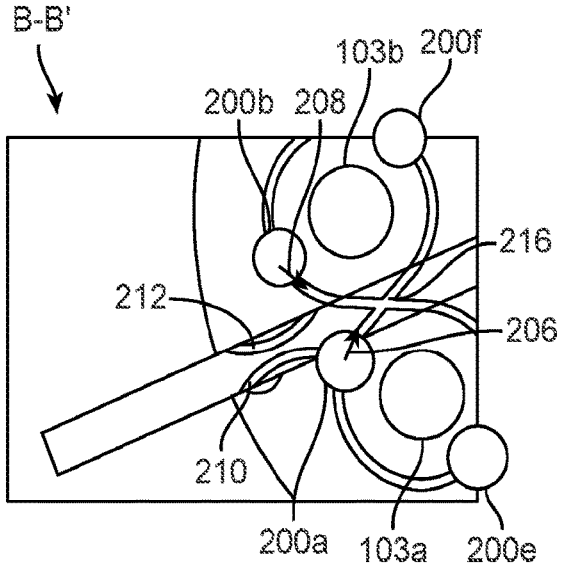
FIG. 2C is a B-B' view of FIG. 1C with carriers shown in a first position when the braiding machine is in the second configuration.
Figure 2D:
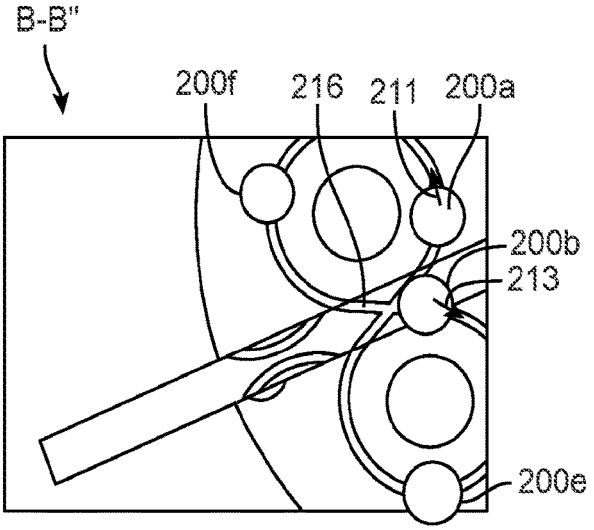
FIG. 2D is a B-B" view of FIG. 1C with carriers shown in a second position when the braiding machine is in the second configuration.

FIGS. 2C and 2D illustrate that when the braider 100 is in the open configuration, the first carrier 200*a* can move along the first horngear path 132 in the first carrier translation first direction 206 toward the second horngear 103*b* and then move immediate to the second horngear 103*b* through a first non-bifurcated channel 216 (or shuttle track) and move into the second horngear path 134*b* in a first carrier translation third direction 211 further away from the first horngear 103*a*. Similarly, the second carrier 200*b* and the second shuttle 352 coupled to the second carrier 200*b* can move along the second horngear 134*b* (or second carrier path) in a second carrier translation direction 208 toward the first horngear and then move immediately to the first horngear 103*a* through the first non-bifurcated channel 216 and move into the first horngear path 132 in a second carrier translation third direction 213 further away from the second horngear 103*b*.

Figure 3A:
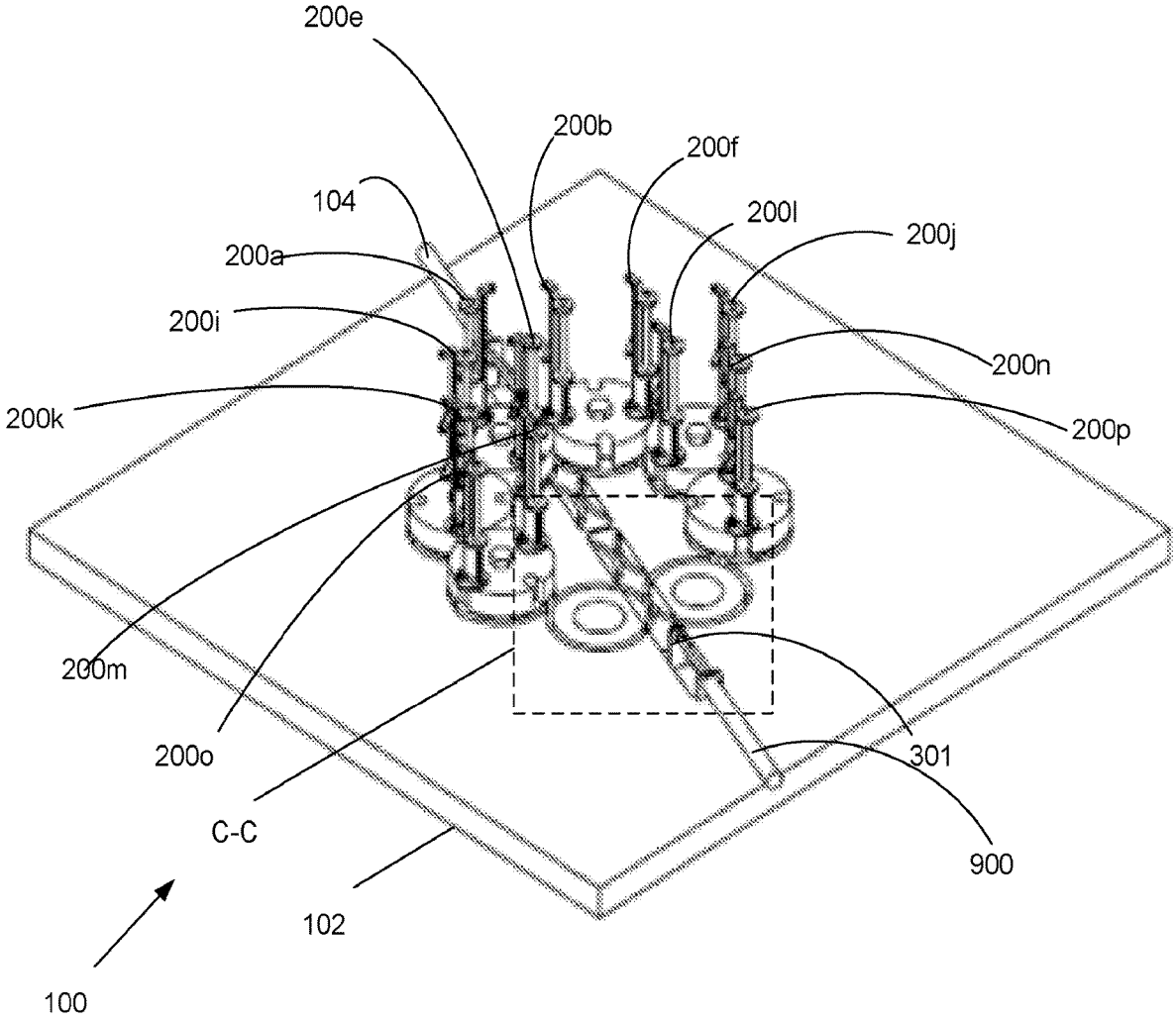
FIG. 3A is a top perspective view of a variation of the braider with the horngears above the top plate.
Figure 3B:
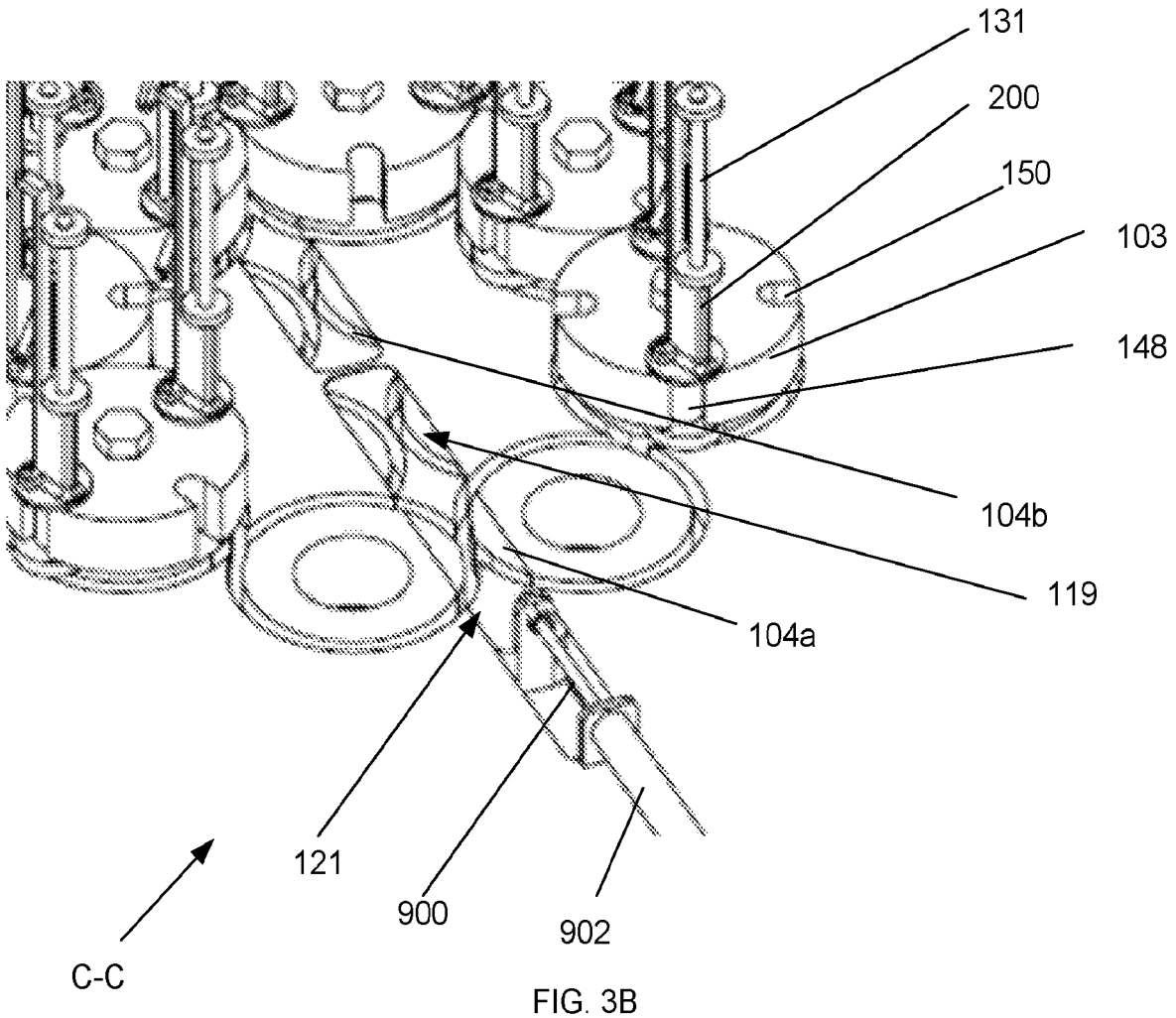
FIGS. 3B through 3D are variations of section C-C of FIG. 3A.

FIGS. 3A and 3B illustrate that the horngears 103 can be above the top plate 102. The carrier 200 can have or be attached to a carrier base, carrier foot, or shuttle 148 extending from the remainder of the carrier 200 in the direction of the horngear 103. The horngear 103 can have one or more horngear notches 150 (e.g., four, as shown, at 90° to each other with respect to the horngear axis). The shuttle 148 can slidably engage into the horngear notch 150. When the horngear 103 rotates about the horngear axis, the horngear notch 150 can transmit rotational energy to the shuttle, for example, rotating the carrier around the horngear axis until the shuttle reaches an empty horngear notch of an adjacent horngear, at which point the shuttle can transfer to the adjacent horngear if otherwise unimpeded, such as by a closed switching gate on the bifurcation bar 104.

The first horngear 103*a* can be coupled to the first carrier 200*a* and fifth carrier 200*e* via the first shuttle 350 and fifth shuttle 358, respectively. The second horngear 103*b* can be coupled to the second carrier 200*b* and sixth carrier 200*f* via the second shuttle 352 and the sixth shuttle 360, respectively. The third horngear 103*c* can be coupled to a third carrier 200*c* and a seventh carrier 200*g* via a third shuttle 354 and seventh shuttle 362, respectively. The fourth horngear 103*d* can be coupled to a fourth carrier 200*d* and an eighth carrier 200*h* via a fourth shuttle 356 and an eighth shuttle 364, respectively. The fifth horngear 103*e* can be coupled to a ninth carrier 200*i* and an eleventh carrier 200*k* via ninth shuttle 366 and an eleventh shuttle 370, respectively. The sixth horngear 128 can be coupled to a tenth carrier 200*j* and a twelfth carrier 2001 via a tenth shuttle 368 and a twelfth shuttle 372, respectively. The seventh horngear 103*g* can be coupled to a thirteenth carrier 200*m* and fifteenth carrier 200*o* via a thirteenth shuttle 374 and a fifteenth shuttle 378, respectively. The eighth horngear 103*h* can be coupled to a fourteenth carrier 200*m* and a sixteenth carrier 200*p* via a fourteenth shuttle 376 and a sixteenth shuttle 380.

Figure 3C:
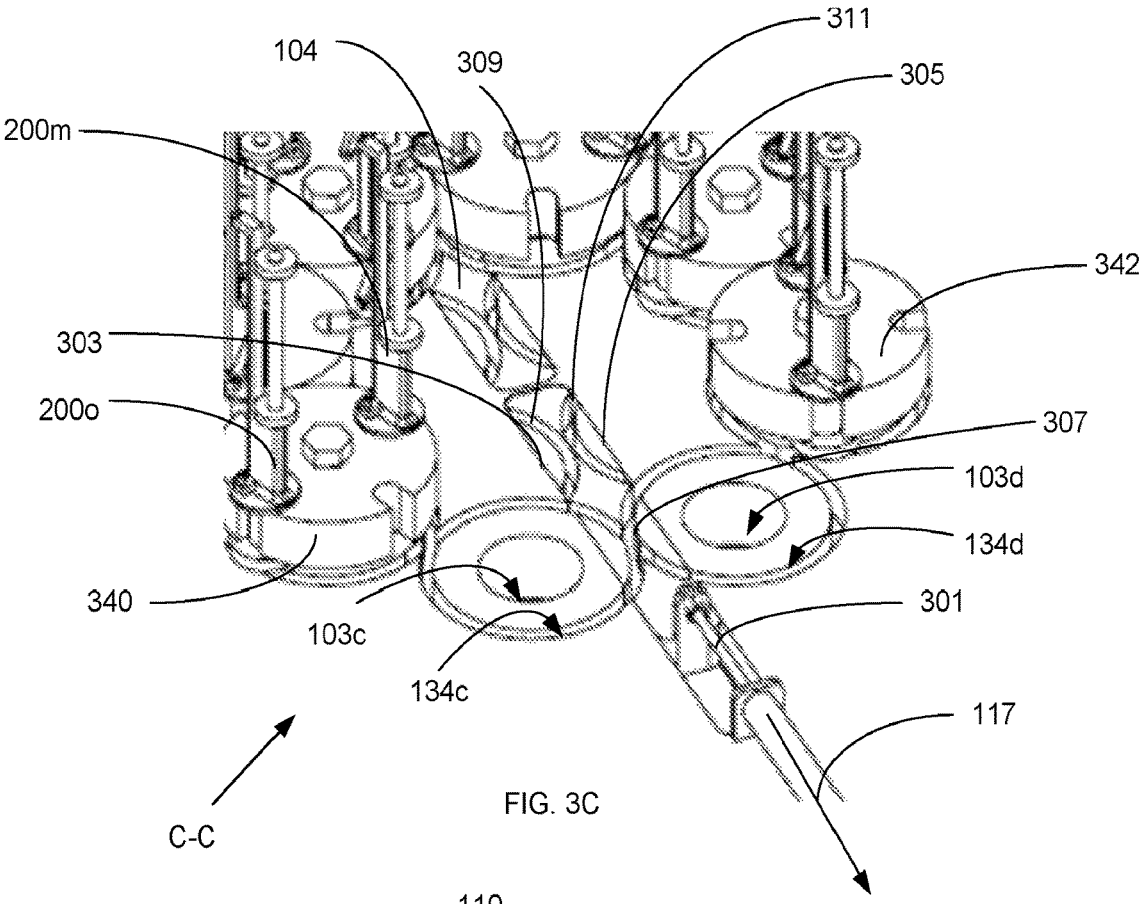
Figure 3D:
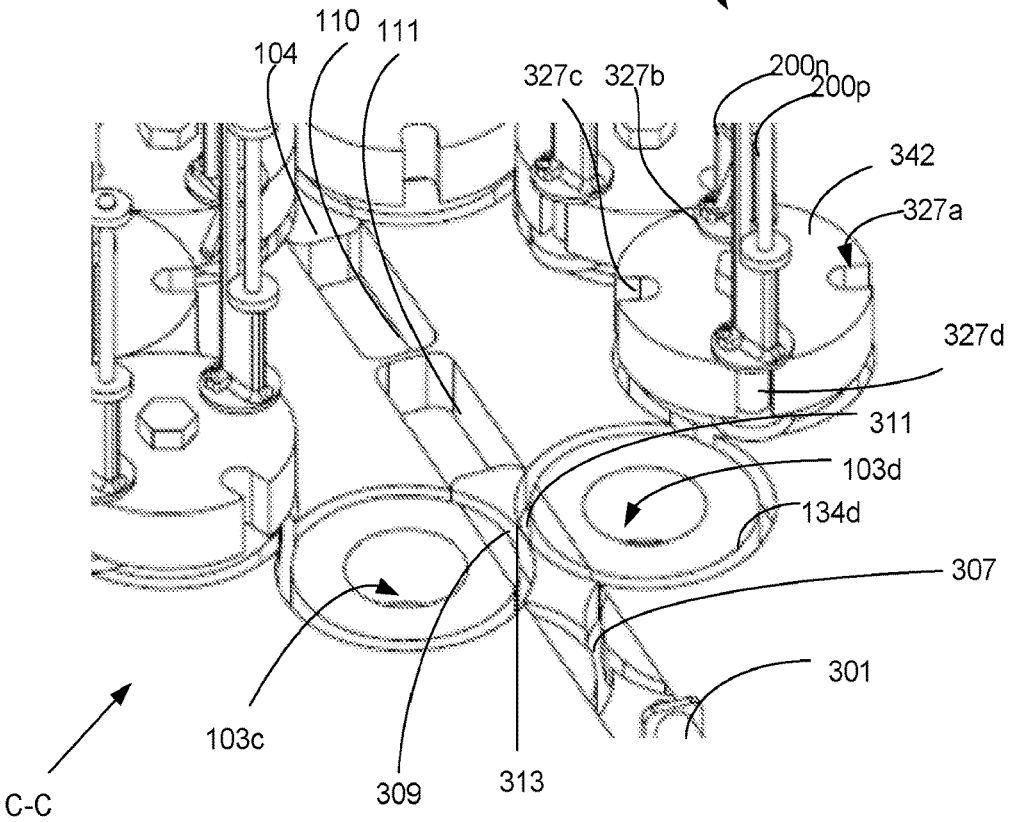
Figure 3E:
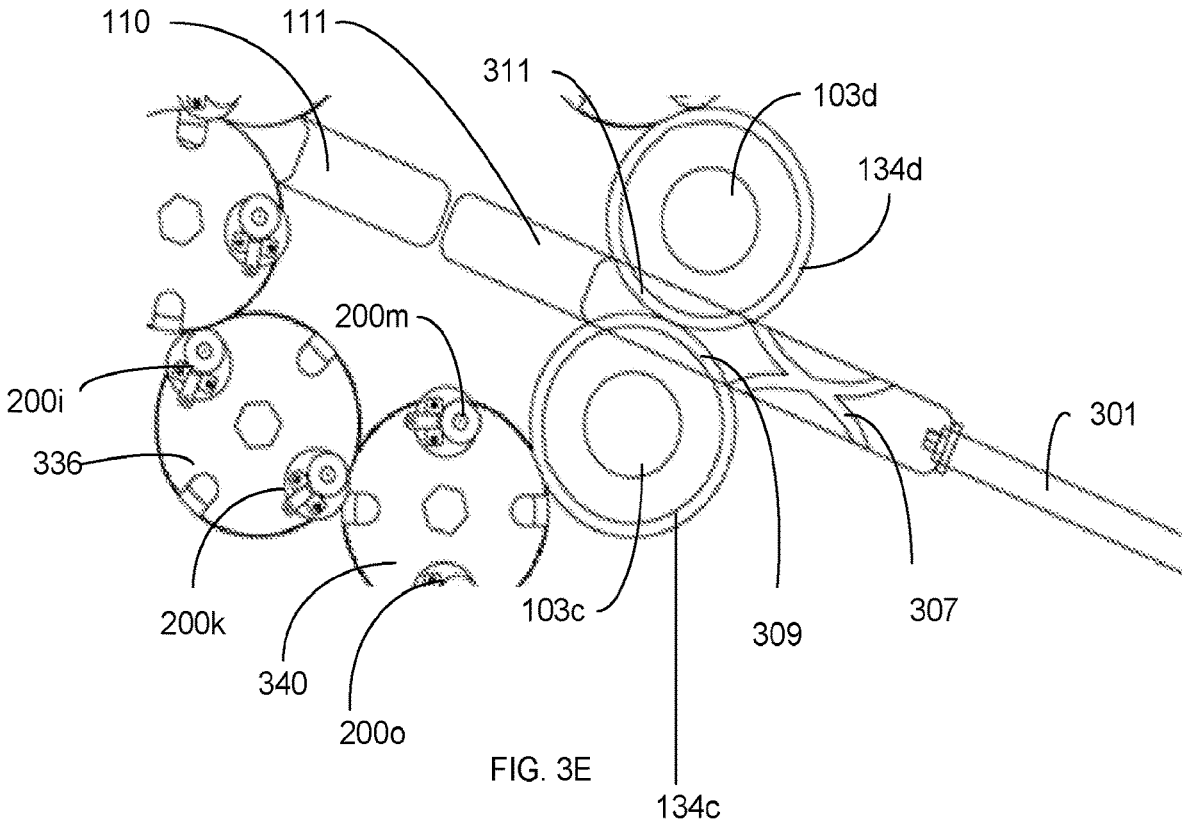
FIG. 3E is a partial top view of a variation of the braider.

FIG. 3B further illustrates that the braider 100 can have the first bifurcation bar 104 and a second bifurcation bar 301. FIGS. 3C and 3D illustrates that the second bifurcation bar 301 can slide within a bifurcation second bar track 111, transitioning between the closed configuration and the open configuration.

FIG. 3C further illustrates that when the second bifurcation bar 301 is in the open configuration, a second non-bifurcated channel 307 can align with the third horngear path 134*c* and the fourth horngear path 138. Sliding the second bifurcation bar 301 in the second direction 117 can transition the second bifurcation bar 301 from the open configuration (FIG. 3C) to the closed configuration (FIG. 3D). FIG. 3D further illustrates that when the second bifurcation bar 301 is in the closed configuration, a third bifurcated channel 309 and a fourth bifurcated channel 311 of the second bifurcation bar 301 can align with the third horngear path 134*c* and the fourth horngear path 138, respectively.

FIG. 3B and FIG. 4 illustrate that the carriers can be coupled to plates that turn with the carriers via the horngears allowing the carriers to move from one horngear to another. By way of example, FIG. 3D illustrates that the eighth plate 342 can comprise a first slot 327*a*, a second slot 327*b*, a third slot 327*c*, and a fourth slot 327*d* wherein the fourteenth carrier 200*n* and the sixteenth carrier 200*p* can sit in the second slot 327*b* and the fourth slot 327*d*. The eighth plate 342 can turn to a position wherein fourth slot 327*d* is aligned with the fourth horngear path 138 wherein the sixteenth carrier 200*p* can leave the fourth slot 327*d* and move into the fourth horngear 103*d*. The other plates on the braider 100 can turn in a similar fashion such that the carriers sitting in their corresponding slots can move into adjacent horngears once properly aligned. The first plate 328 can be coupled to the first horngear 103*a*, the second plate 330 can be coupled to the second horngear 103*b*, the third plate 332 can be coupled to the third horngear 103*c*, the fourth plate 334 can be coupled to the fourth horngear 103*d*, the fifth plate 336 can be coupled to the fifth horngear 103*e*, the sixth plate 338 can be coupled to the sixth horngear 103*f*, the seventh plate 340 can be coupled to the seventh horngear 103*g*, and the eighth plate 342 can be coupled to the eighth horngear 103*h*.

Figure 5A:
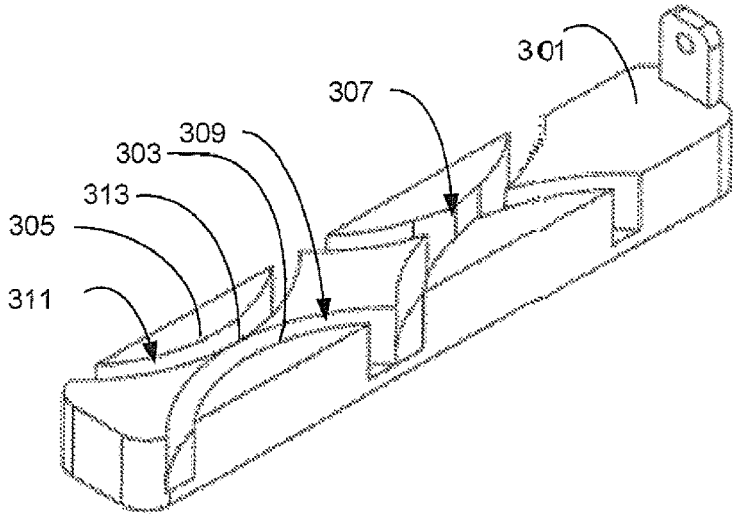
FIGS. 5A and 5B are opposite perspective views of a bifurcation first bar.
Figure 5B:
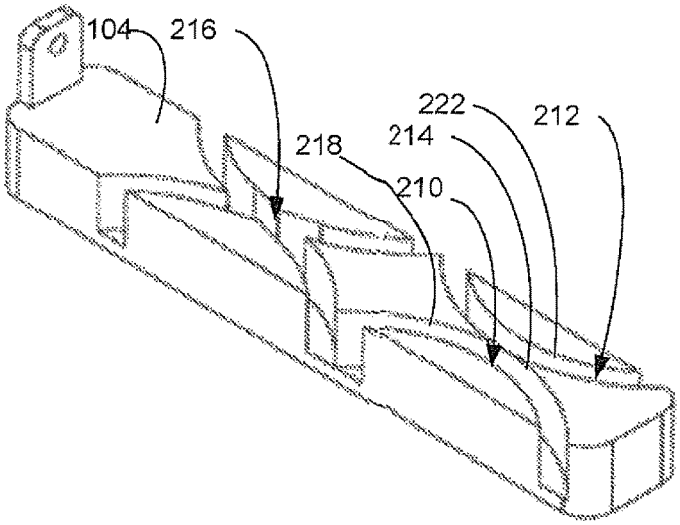

FIGS. 5A and 5B illustrate that the first bifurcated channel 210 and the second bifurcated channel 212 of the first bifurcation bar 104 can be separated by a first bifurcating divider, diverter or guide 214, and the third bifurcated channel 309 and the fourth bifurcated channel 311 of the second bifurcation bar 301 can be separated by a second bifurcating divider, diverter or guide 313. The second bifurcation bar 301 can comprise a first side 305 of the second bifurcation bar 301 against which the third carrier 200*c* and the third shuttle 354 can move against and a second side 303 of the second bifurcation bar 301 against which the fourth carrier 200*d* and the fourth shuttle 356 can move against.

Figure 6A:
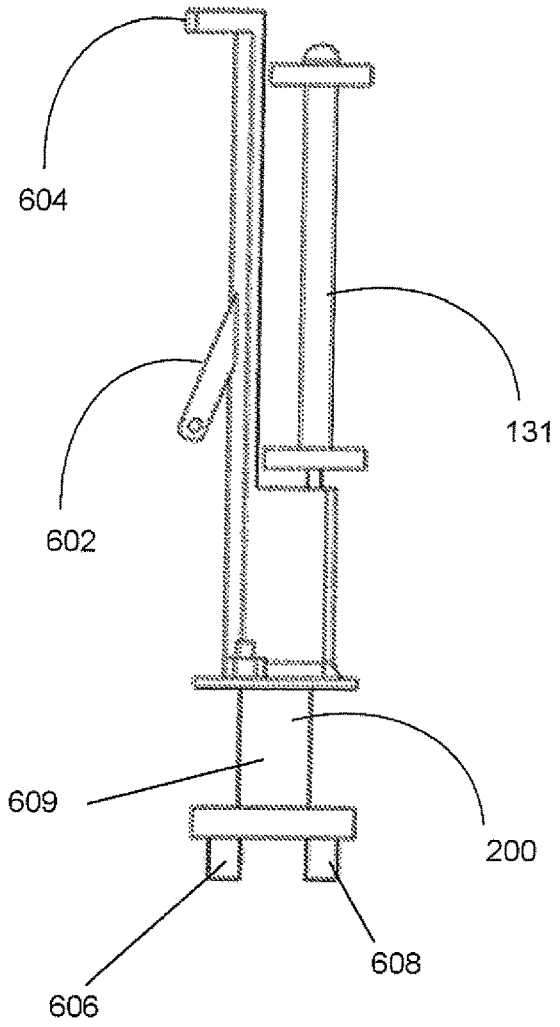
FIGS. 6A and 6B are side and bottom views, respectively of a variation of a portion of the carrier.

FIG. 6A illustrates that the carrier 200 can have a spool or bobbin holder or axle 131. The carrier 200 can have a compensator arm 602. The compensator arm 602 can be rotatably and elastically (e.g., with a spring) attached to the body of the carrier 200, for example rotating in and out relative to the remainder of the carrier 200, and/or slidably (i.e., translatably) and elastically attached to the body of the carrier 200, for example sliding up and down relative to the remainder of the carrier 200. The compensator arm 602 can be a mechanical capacitor for the speed of yarn being delivered by the carrier 200. For example, the compensator arm 602 can rotate up to maintain tension when yarn being delivered from the carrier 200 is increasing in speed, and can rotate down to maintain tension when yarn being delivered from the carrier 200 is decreasing in speed. The carriers 200 can have a yarn guide 604 extending from the top distal end of the carrier 200. The yarn guide can secure a yarn from a spool that can be held by the spool holder 131.

Figure 6B:
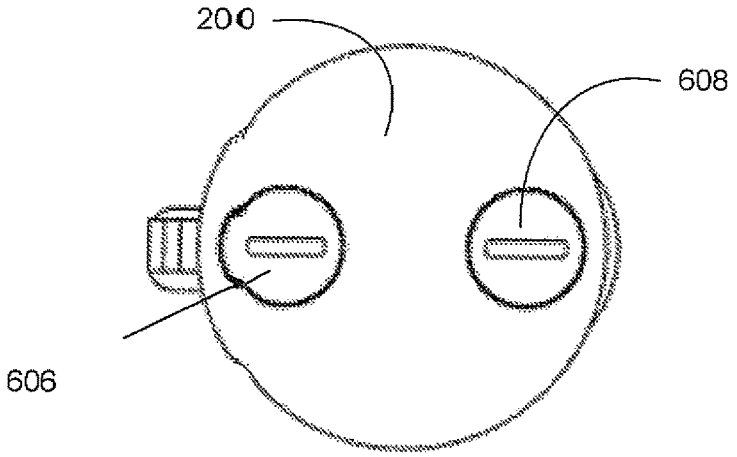

FIGS. 6A and 6B illustrate that the carriers 200 can have carrier first and second feet or track interfaces 606 and 608. The carrier track interfaces 606 and 608 can extend into the carrier track 132 and slidably guide or steer the carrier 200 through the carrier track 132. The carrier track interfaces 606 and 608 can be rotatably connected to the remainder of the carrier 200. The carriers 200 can each have a carrier base 609 that can be configured to engage and disengage with the horngear notches 150. The shuttle 148 can include the carrier base 609 and/or the carrier track interfaces 606 and 608.

Figure 7:
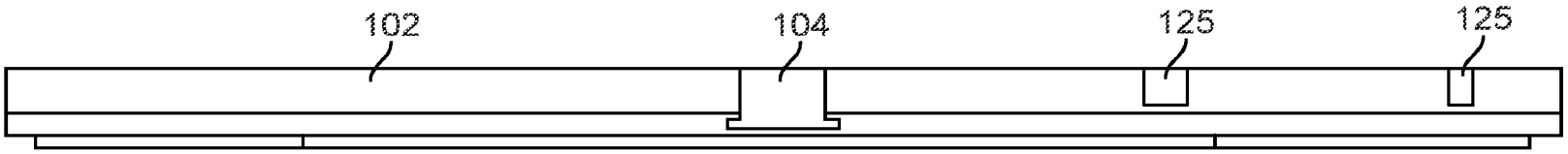
FIG. 7 is a side view of the braider top plate.

FIG. 7 illustrates that the bifurcation bar 104 and/or the loading locks 125 can extend to, and/or past, and/or be flush with the terminal radial peripheral surface of the top plate 102.

Figure 8:
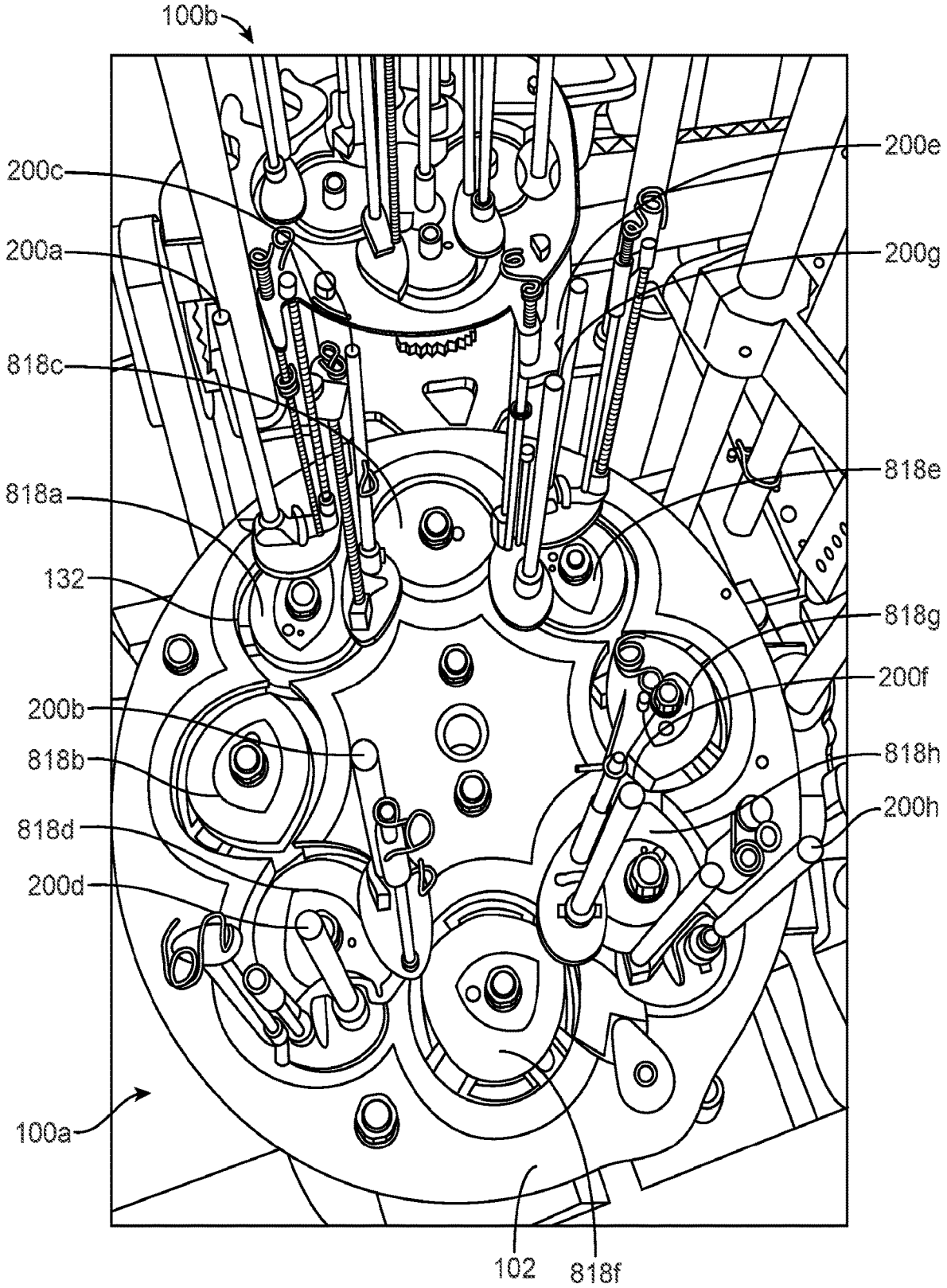
FIG. 8 is a perspective view of another aspect of the braiding machine.

FIG. 8 illustrates that a first braider 100*a* may be adjacent to a second braider 100*b* on the same chassis as the first braider 100*a*. The carriers 200 can be positioned in pairs opposite to each other (e.g., the opposite carrier can be a complementary carrier) with respect to the braider 100. For example, the first carrier 200*a* can be opposite from and complementary, as shown in FIG. 8, to the eighth carrier 200*h*. Each individual carrier 200 and its complemental carrier 200 can move along the carrier path, channel or track 132 in the same direction (e.g., both clockwise or both counter clockwise).

The top plate 102 can have stationary horngear plates 818, such as first through eighth horngear plates 818*a*-818*h*, that can cover the respective horngears 103.

Figure 9A:
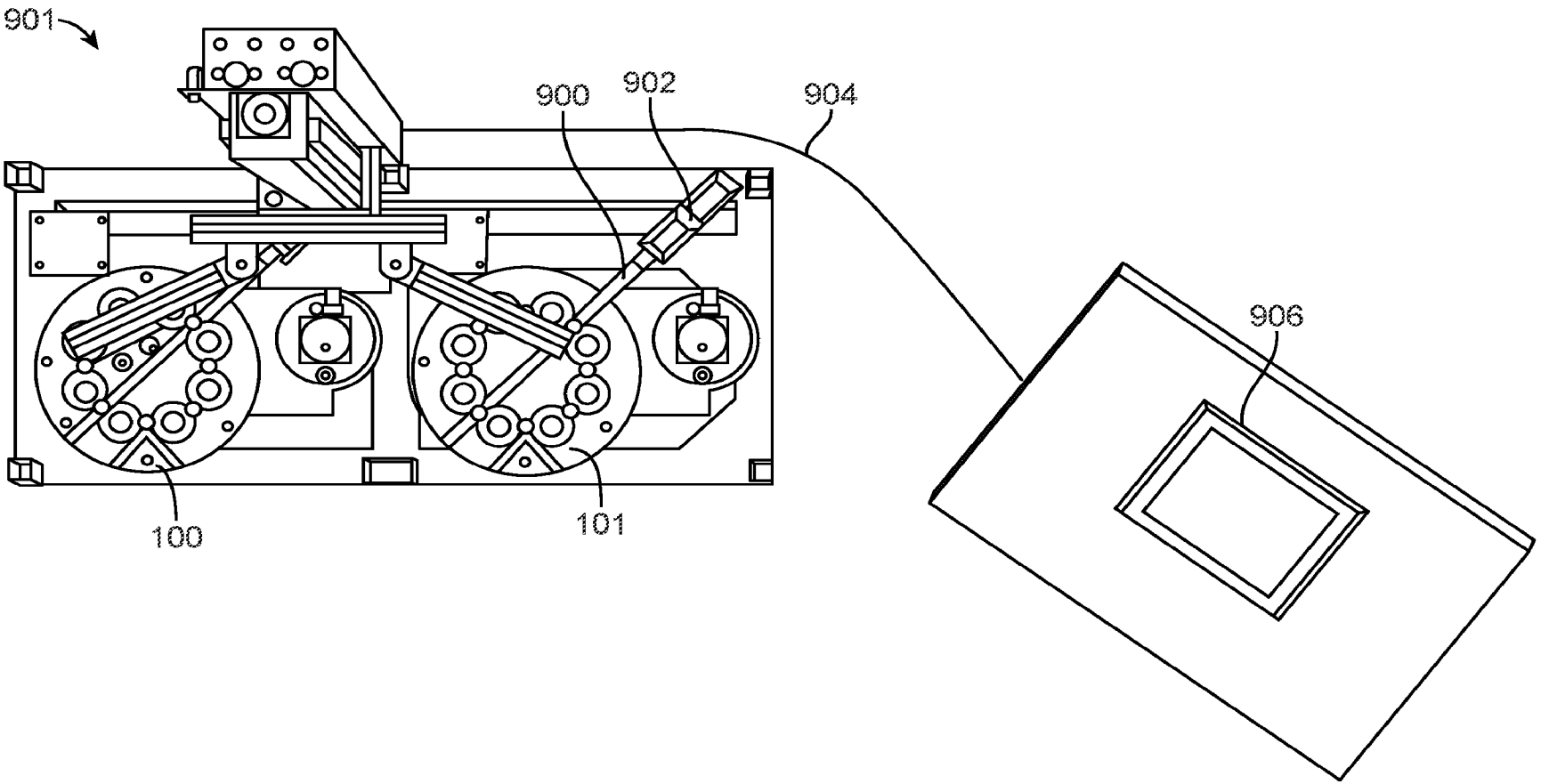
FIG. 9A is a top view of an aspect of a braiding machine control system comprising a first and second braiding machine.
Figure 9B:
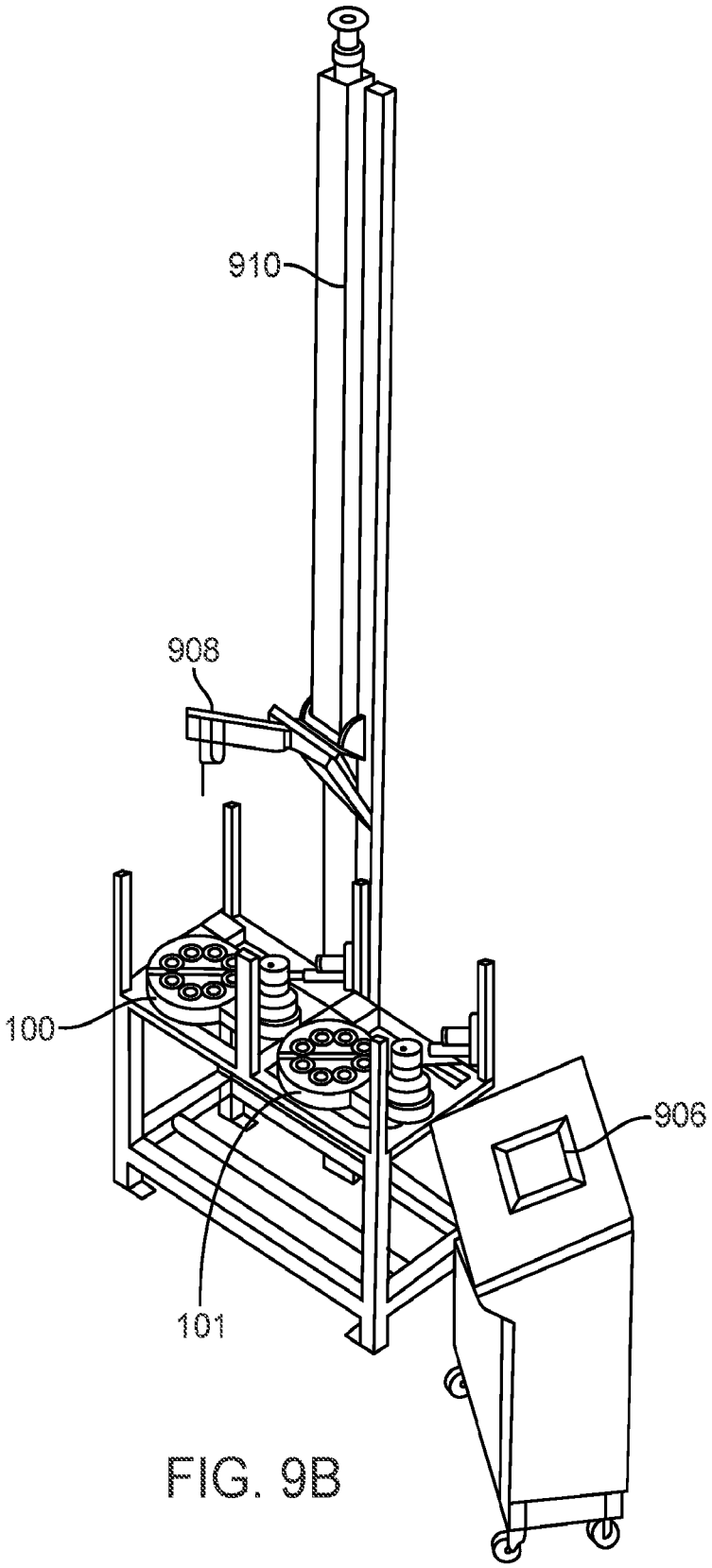
FIG. 9B is a perspective view of the aspect of the braiding machine control system of FIG. 9A.

FIGS. 9A and 9B illustrates that a braiding machine control system 901 can have first and second braiders 100*a* and 100*b* and a controller 906, such as a networked computer having a processor and memory. Separate coupled pairs of a bifurcation rod extensions 900 and a bifurcation rod electromechanical actuator or solenoid 902 can each be coupled to the first and second braiders 100*a* and 100*b*. The controller 906 can instruct the solenoid 902 to push the bifurcation rod extension 900, for example, to slide the bifurcation rod 104 into the open or closed configuration. The braider machine control system 901 can have a wired connection 904 to connect the braiding controller 906 to the solenoids 902.

The controller 906 can control and/or monitor the speed of rotation of the horngears 103.

The system 901 can have a vertical support 910. The system 901 can have an elevating mount 908, for example, attached to and vertically slidable with respect to the vertical support 910. The elevating mount 908 can be attached to an elevating pulley 1000 and/or collector hook 1012 and/or take up mandrel. The vertical support 910 can have an elevating motor controlled by the braiding controller 906. The controller 906 can control the elevating motor to elevate elevating mount, and/or the elevating pulley 1000 and/or collector hook 1012 and/or take up mandrel, and, for example, the elevating rate can depend on the speed of the horngears 103.

Figure 10:
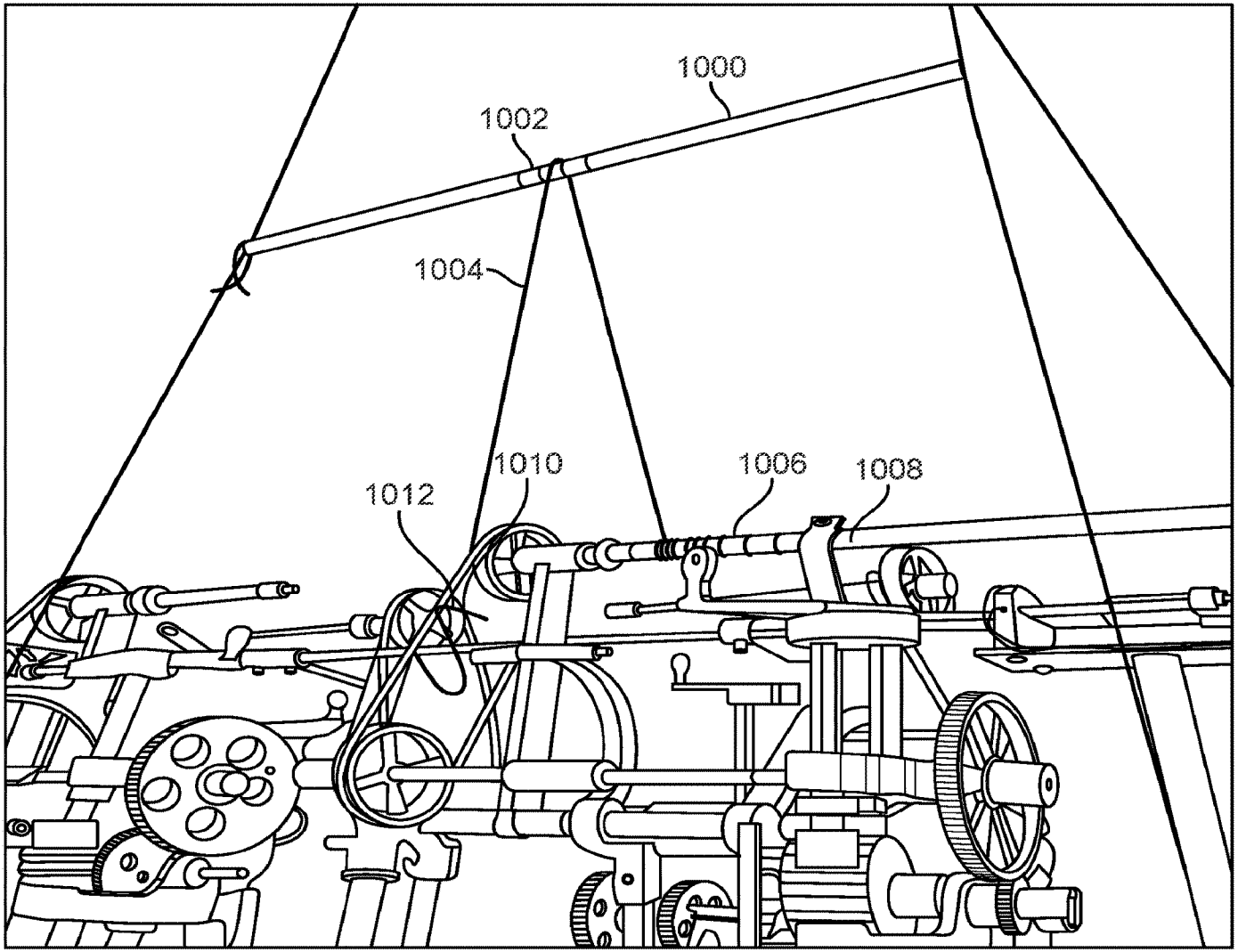
FIG. 10 is a perspective view of an aspect of a suture stabilization system.

FIG. 10 illustrates that an elevating pulley 1000 can be secured above a take up mandrel 1008 wherein a braided suture leader 1004 can be wound around the take up mandrel 1008 in an evenly distributed fashion 1006 and up around the elevating pulley 1000 between copper ties 1002 that secure the elevating leader 1004 and back down and tied to a collector hook 1012 by an elevating leader knot 1010.

Figure 11:
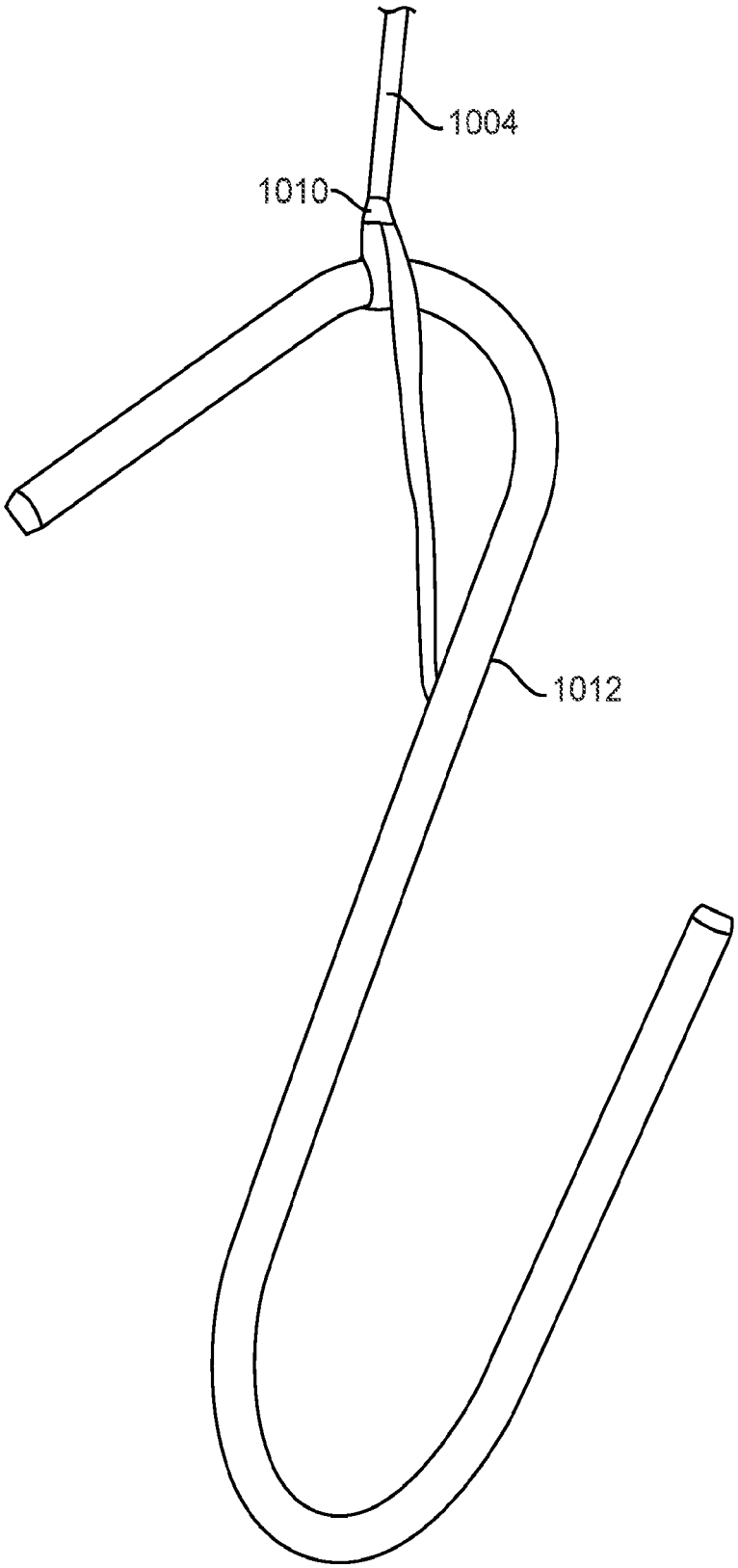
FIG. 11 illustrates a suture leader tape knot on a collector hook in one aspect.

FIG. 11 illustrates the elevating leader 1004 can be tied around a first end of an S-shaped collector hook 1012 at an elevating leader knot 1010. The braided textile can be braided around the second end of the S-shaped collector hook 1012.

Figure 12:
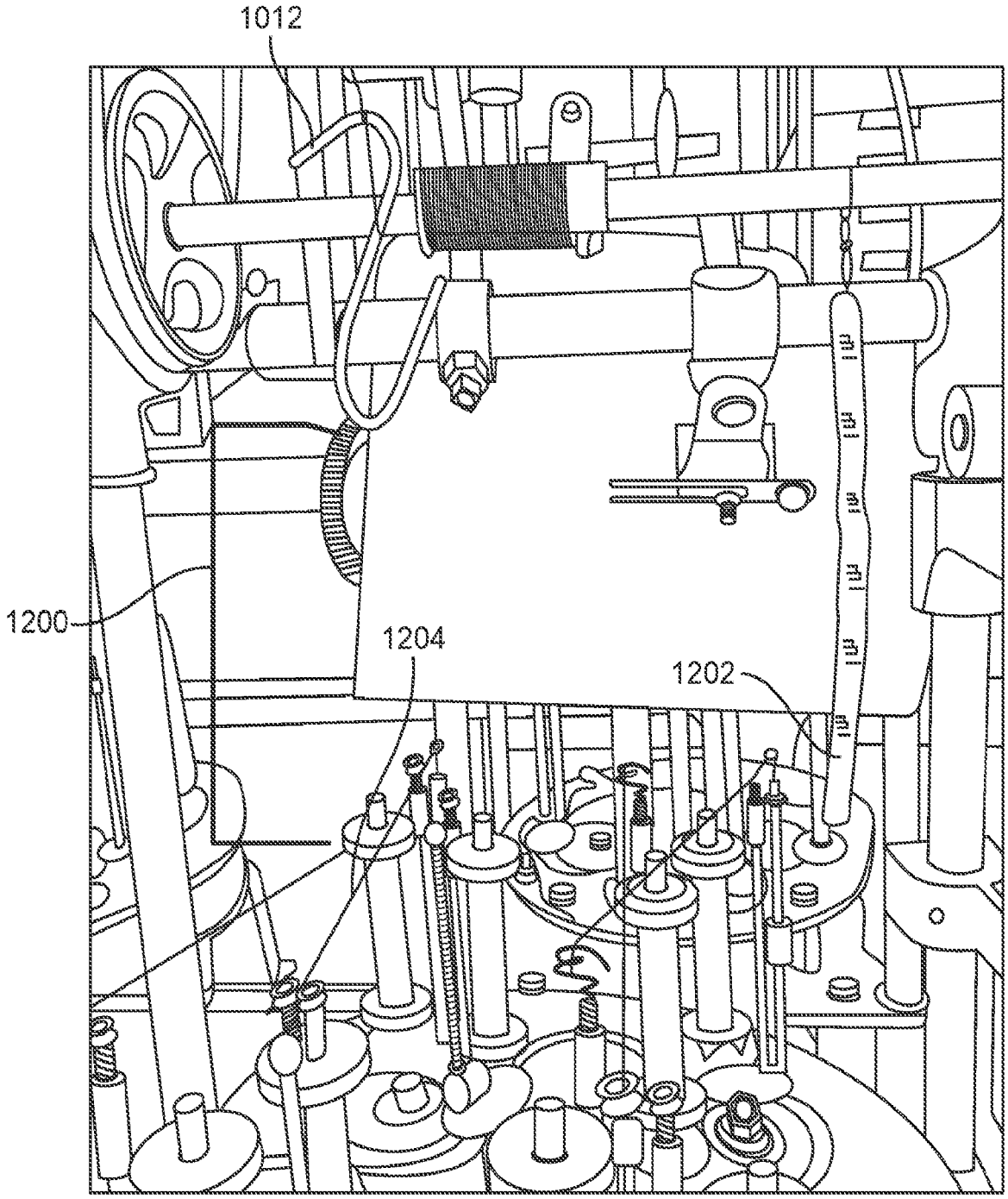
FIG. 12 is a perspective view of an aspect of the suture stabilization system above an aspect of the braiding machine.
Figure 13A:
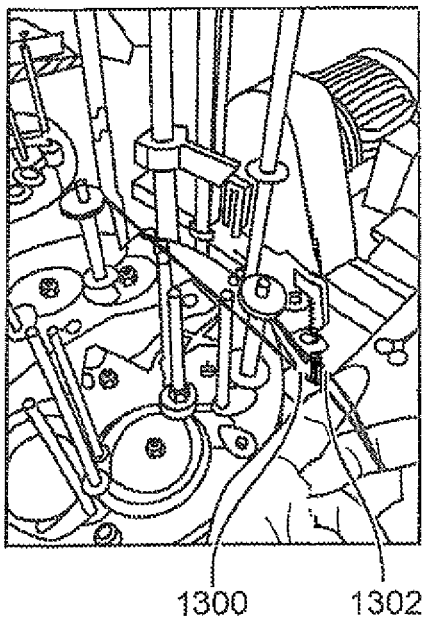
FIGS. 13A-13F illustrate a variation of a method for creating a double-loop knot using yarn from a first carrier and yarn from a first carrier complement.
Figure 13B:
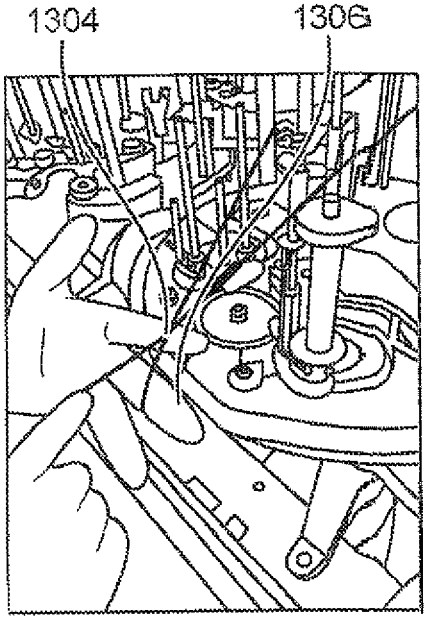
Figure 13C:
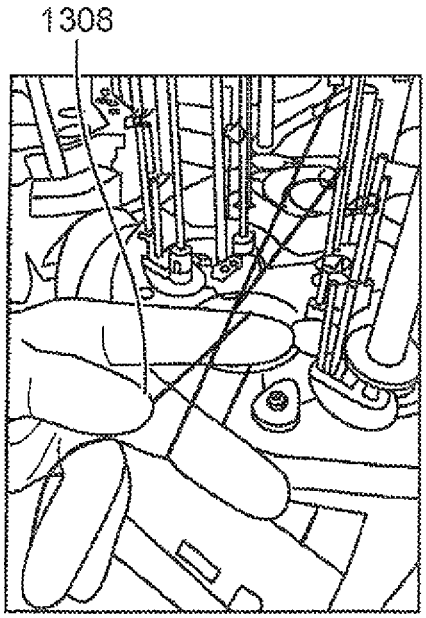
Figure 13D:
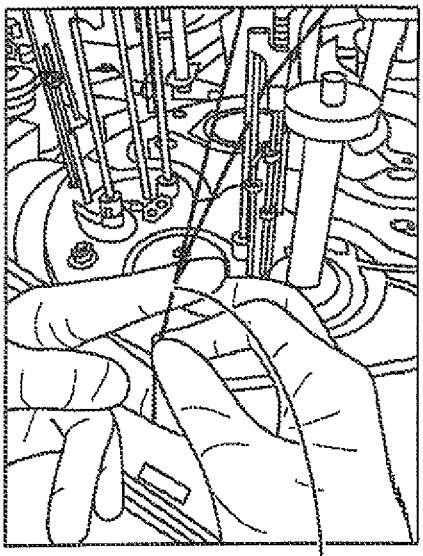
Figure 13E:
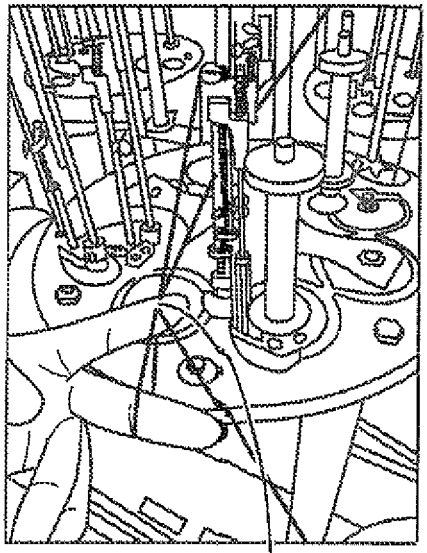
Figure 13F:
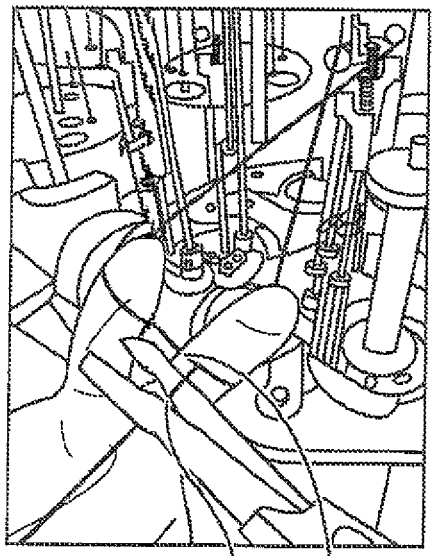

FIG. 12 illustrates that a ruler 1202 can be used to measure a distance 1200 between the collector hook 1012 to a top 1204 of a carrier, such as the first carrier 800 on the first braider 100 for example.

FIGS. 13A-13F illustrate that an attachment, such as double-loop knot 1316, between two yarns from opposite carriers can be formed. The attachments can be formed by any method including tying a knot, ultrasonic welding, epoxying or gluing with a liquid, clipping with a clipping element, applying shrink tubing, or combinations thereof. For example, a first yarn 1300 from the first carrier 200*a* can be grabbed along with a second yarn 1302 from the eighth carrier 200*h*. Then the first yarn 1300 and the second yarn 1302 can be crossed at a crossing point 1304 and the first yarn 1300 and second yarn 1302 can be wrapped 1306 around a first holder, such as a finger. Then, the first yarn 1300 and the second yarn 1302 can be held down 1308 by a second holder, such as a thumb. Then the first yarn 1300 and the second yarn 1302 can be pulled through a loop 1310. Then a knot 1312 is form when the first yarn 1300 and the second yarn 1302 can be pulled. The method shown in FIGS. 13C-13E can be repeated such that the double-loop knot 1316 can be formed and then tails 1314 of the first yarn 1300 and the second yarn 1302 can be cut.

Figure 14:
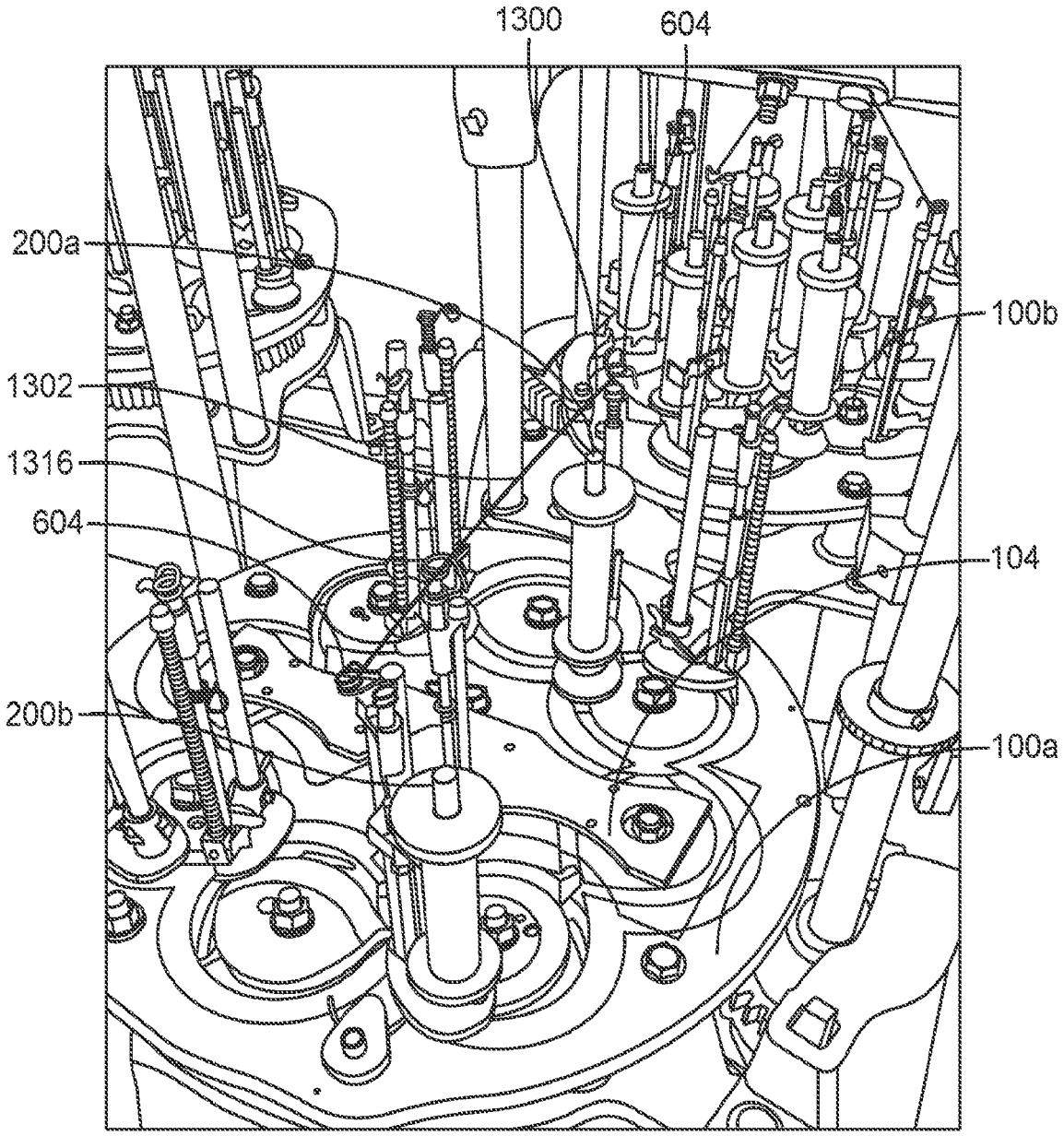
FIG. 14 is a perspective view of a braiding machine with yarn from the first carrier and yarn from the first carrier complement tied together in a double-loop knot.

FIG. 14 illustrates that the first yarn 1300 and the second yarn 1302 can be tied at the double-loop knot 1316. The first carrier 200*a* holding the first yarn 1300 and the eighth carrier 200*h* holding the second yarn 1032 can be on opposite sides of the bifurcation bar 104 coupled to braider top plate 102. The bifurcation bar 104 can sit on top of the braider top plate 102 and block two horngears such that only six out of the eight horngears are operable when the bifurcation bar 104 is coupled to the braider top plate 102.

Figure 15:
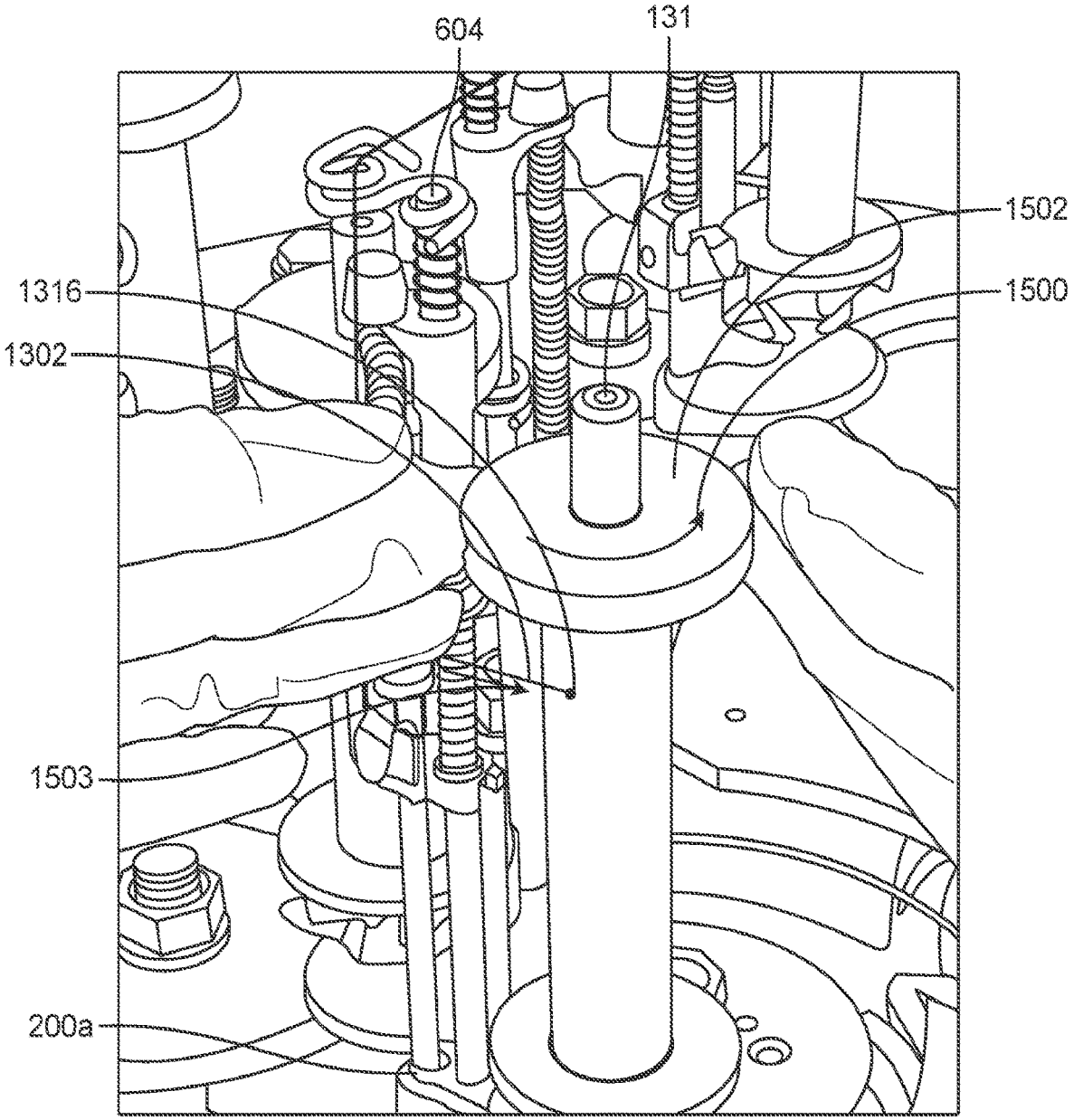
FIG. 15 is a perspective view of a carrier with a spool and a double-loop knot reeled back into the spool.

FIG. 15 illustrates that a spool 1502 coupled to the spool holder 131 of the first carrier 200*a* can be reeled back, as shown by arrow 1500. The tied together first and second yarns 1300 and 1302 can then be pulled toward and into the spool 1502, as shown by arrows 1503. The double-loop knot 1316 can then be so deeply buried into the remaining yarn on the spool 1502 that when the braider 100 completes the desired braided textile, the double-loop knot 1316 can remain in the spool 1502. For example, after the double-loop knot 1316 contacts the remaining yarn in the spool 1502, the spool can be rotated, for example, greater than about 25 revolutions, more narrowly between about 50 revolutions and about 3,000 revolutions, more narrowly from about 100 revolutions to about 1,000 revolutions, to pull and embed the knot 1316 into the yarn of the yarn already on the spool 1502. Also for example, the double-loop knot 1316 can be pulled away from the collector hook 1012 and/or past the initial contact with the yarn already wound to the spool 1502 for a length equal to or greater than the lay length of the construct or desired braided textile multiplied by a longitudinal length of the desired braided textile. (The frayed cut ends of the excess yarn from the knot can be seen in FIG. 15, helping to visualize the location of the knot 1316.)

Figure 16:
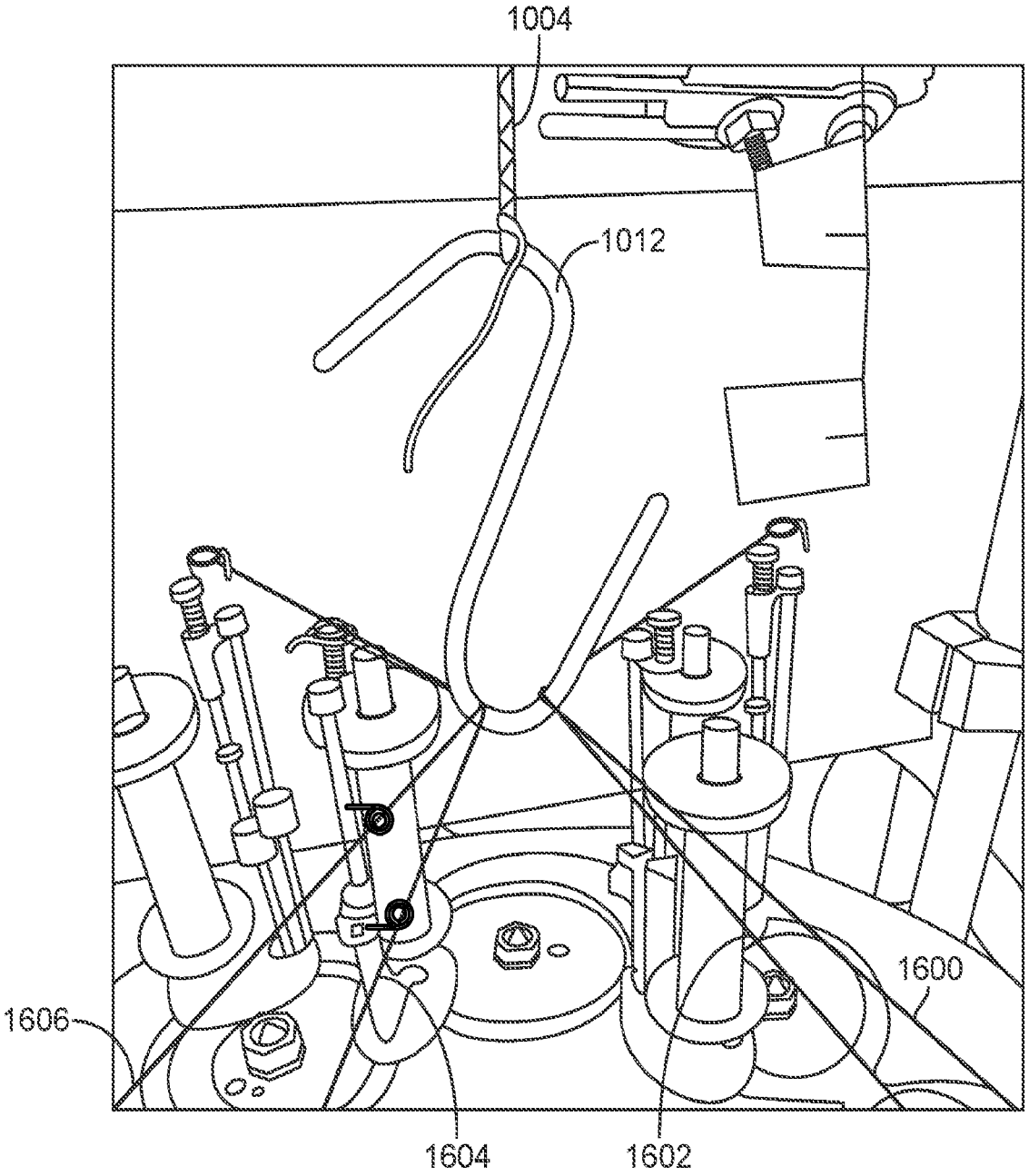
FIG. 16 is a perspective view of four tied yarns looped on a collector hook above an aspect of the braiding machine.
Figure 20A:
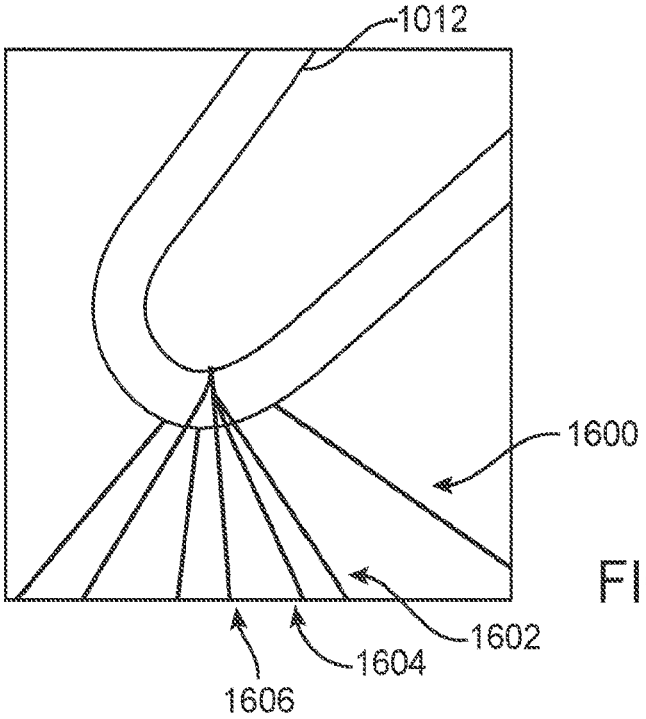
FIGS. 20A-20C are perspective views of a variation of the method for braiding the braided suture loop on the collector hook.

FIGS. 16 and 20A illustrate that a first tied yarn 1600 can be formed by tying the first yarn 1300 from the first carrier 200*a* with the second yarn 1302 from the eighth carrier

200*h*. A second tied yarn 1602 can be formed the same way from yarn from the second carrier 200*b* and the seventh carrier 200*g* (e.g., the complimentary carrier to the second carrier), and for the yarn from the remaining complementary carrier pairs, resulting in a third tied yarn 1604 and a fourth tied yarn 1606, respectively. After their respective knots or other attachment points have been buried into their respective spools, as shown and described in FIG. 15 and above, the first, second, third and fourth tied yarns 1600, 1602, 1604, and 1606 can be looped onto the collector hook 1012 one-by-one, for example as each one is tied, or concurrently.

Figure 17:
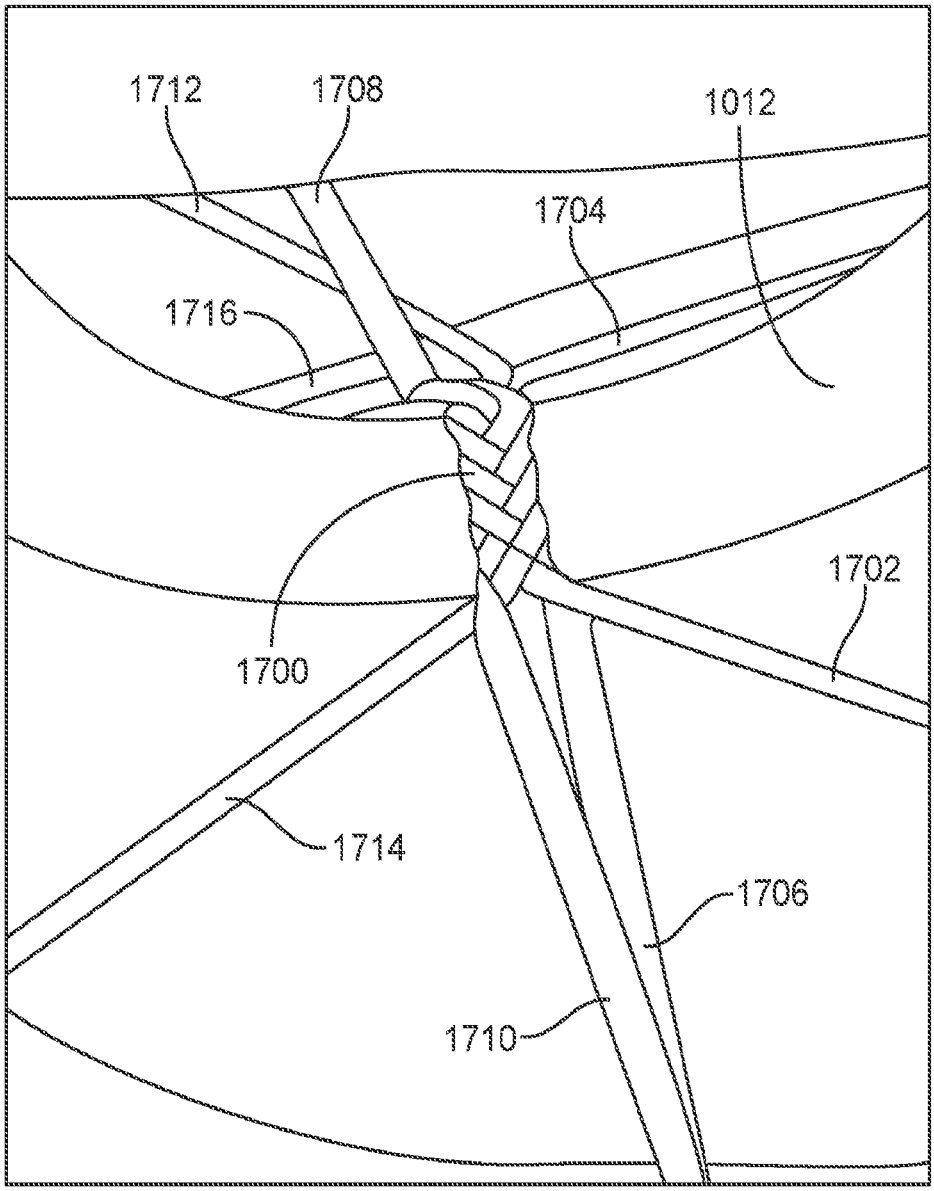
FIG. 17 is a perspective view of four tied yarns partially braided forming a pre-closing braided loop on a collector hook.
Figure 20B:
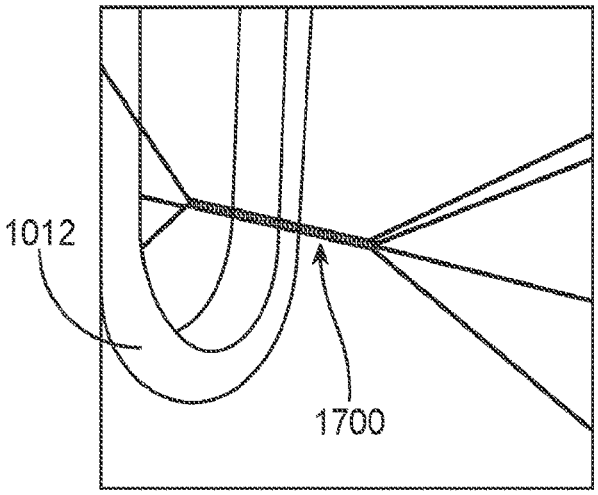

FIGS. 17 and 20B illustrate that a braided suture loop 1800 can then be braided when the bifurcation bar(s) 104 is(are) in a bifurcated configuration. The braider 100 can produce two maypole braids, one for each side of the braided textile extending from the collector hook 1012. The first tied yarn 1600 can have a first tied yarn first end 1702 and a first tied yarn second end 1704. The second tied yarn 1602 can have a second tied yarn first end 1706 and a second tied yarn second end 1708. The third tied yarn 1604 can have a third tied yarn first end 1710 and a third tied yarn second end 1712. The fourth tied yarn 1606 can have a fourth tied yarn first end 1714 and fourth tied yarn second end 1716.

The open braided loop 1700 can be formed by braiding the first tied yarn 1600, the second tied yarn 1602, the third tied yarn 1604, and the fourth tired yarn 1606 when the bifurcation bar(s) 104 is(are) in a bifurcated configuration. The first, second, third and fourth tied yarn first ends 1702, 1706, 1710, and 1714 can braid amongst one another forming a four-strand braid on a first side of the pre-closing braided loop 1700 extending from the hook 1012. The first, second, third and fourth tied yarn second ends 1704, 1708, 1712, and 1716 can braid amongst one another to form a four-strand braid on a second side of the pre-closing braided loop 1700 extending from the hook 1012.

Figure 18:
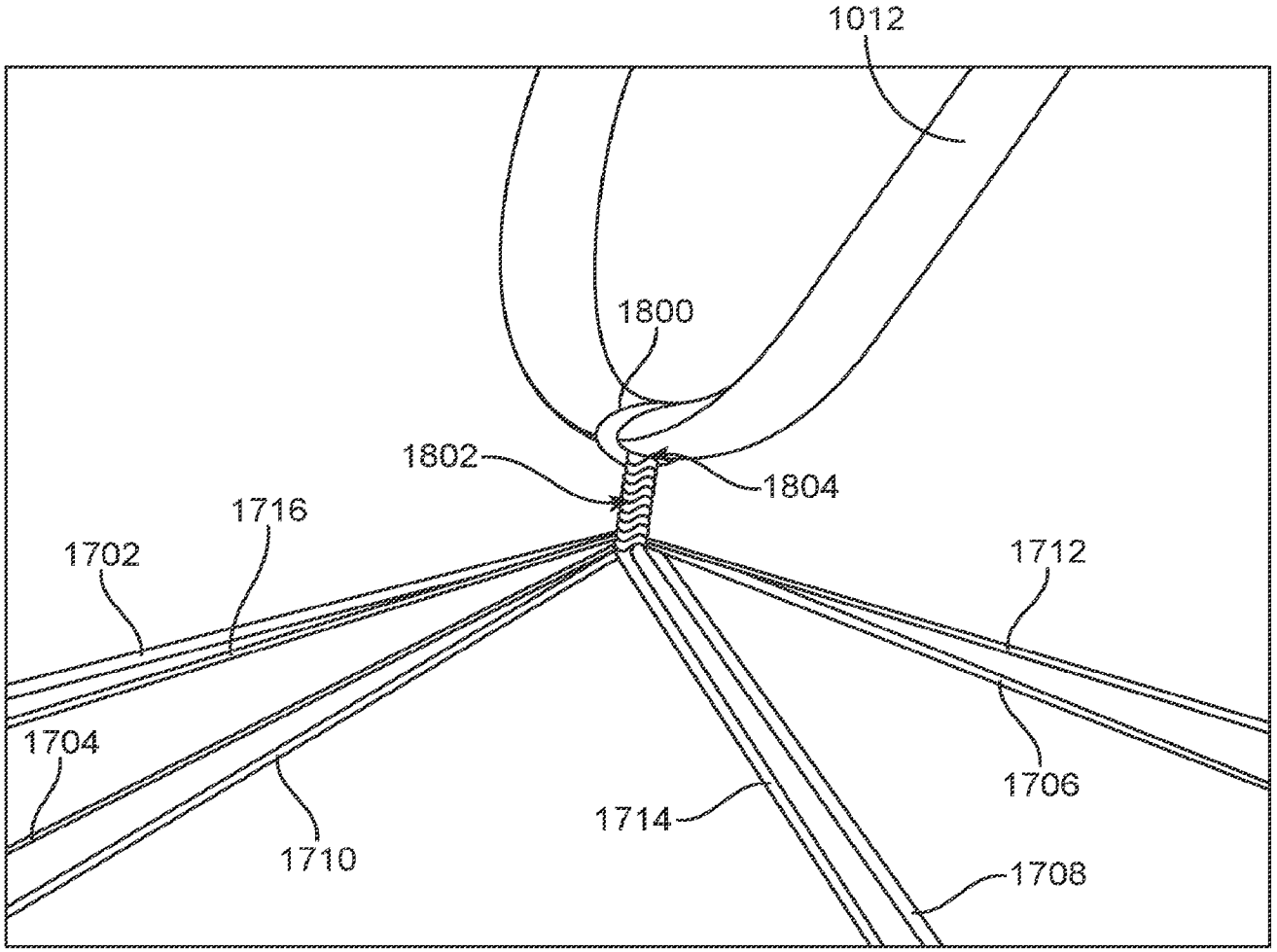
FIG. 18 is a perspective view of a braided suture loop formed on the collector hook with a single maypole braided suture tail.
Figure 19:
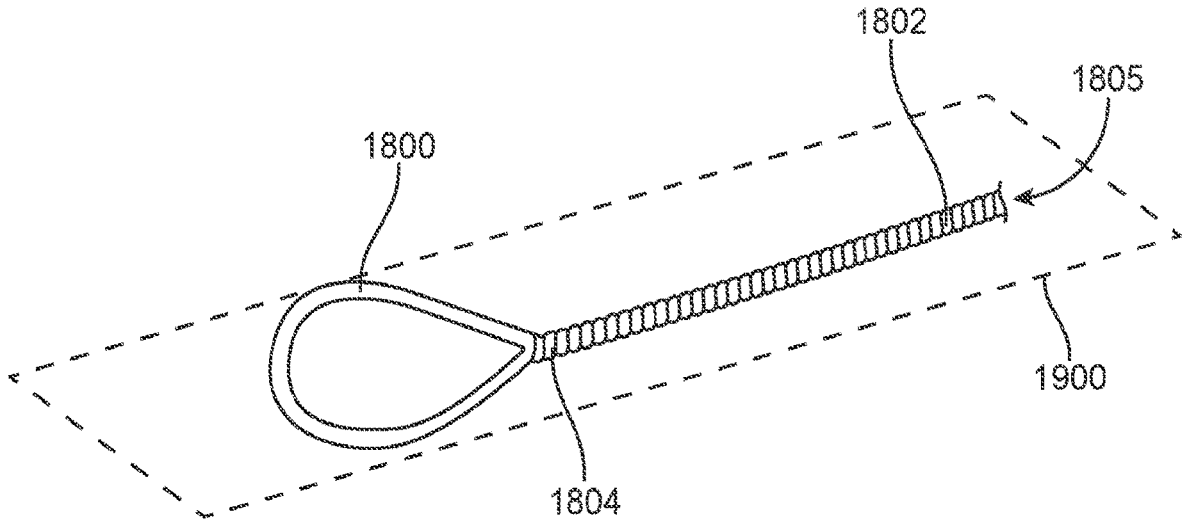
FIG. 19 is a perspective view of the braided suture loop with the single maypole braided suture tail.
Figure 20C:
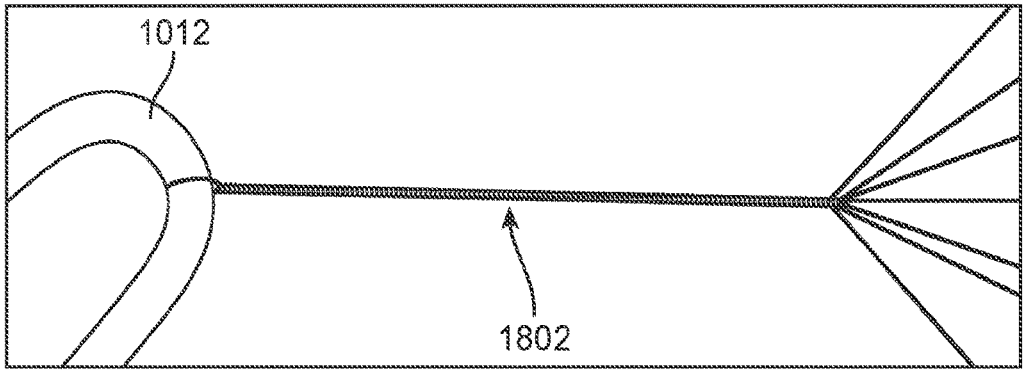

FIGS. 18 and 20C illustrate that after the bifurcation bar(s) 104 is(are) moved to an open configuration, a braided suture closed loop 1800 braided around the collector hook 1012 can then be formed. A single maypole braid suture tail 1802 extending from a converge or bifurcation end point 1804 at the closure point of the closed-loop can be braided. The first, second, third, and fourth tied yarn first ends 1702, 1706, 1710, 1714, and the first, second, third and fourth tied yarn second ends 1704, 1708, 1712, and 1716 can braid amongst one another to form the single maypole braid suture tail 1802.

Figure 21:
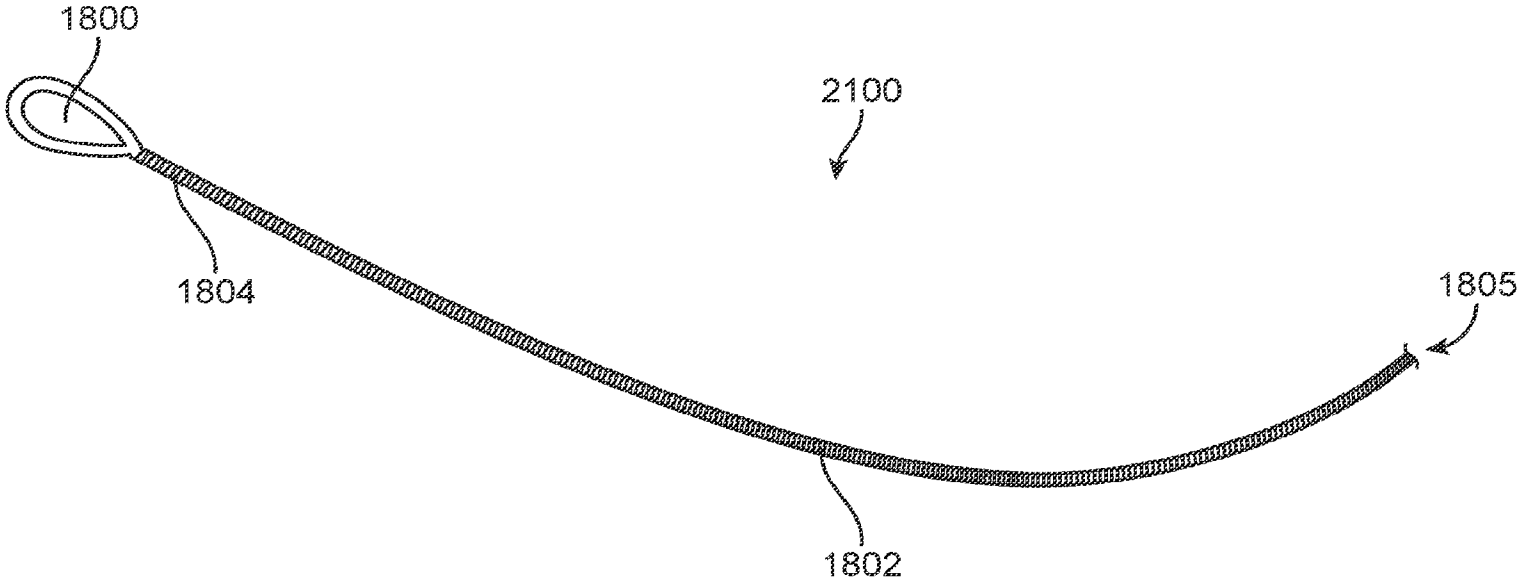
FIG. 21 is a perspective view of the braided suture loop with the single maypole braided suture tail.

FIGS. 18, 20C, and 21 illustrate that both sides or ends of the loop 1800 and the respective yarns can converge continuously at the convergence, divergence, or bifurcation end point 1804 and extend to the tail 1802. The loop 1800 can be an interbraided braid. All, or at least more than half, of the yarns on both side of the loop 1800 can extend continuously into the single maypole braid of the tail 1802. All, or at least more than half, of the yarns of the single maypole braid of the tail 1802 can extend continuously into the loop 1800. The resulting braided textile suture or construct 2100 can have a completely closed loop 1800 and tail 1802 having a shear cut tail terminal end 1805.

The distal end of the braided textile can have a closed loop 1800 of an interbraided braid, and the proximal end having the tail 1802. Once removed from the collector hook 1012, the hole in the lasso-shaped closed loop can be where the collector hook 1012 was positioned during the braiding of the braided textile.

FIGS. 22A and 22B illustrate that construct 2100 can have reinforcement grommet 2200 in the closed loop 1800. The reinforcement grommet can be made from any of the materials listed elsewhere herein as well as plastic, rubber, or combinations thereof. The grommet 2200 can be rigid or flexible. The grommet 2200 can be elastic and resilient. The grommet 2200 can be coated with a friction reducing material such as PTFE. The grommet 2200 can be circular, oval, octagonal, square, rectangular, triangular, teardrop-shaped (e.g., the shape of the area inside of the closed loop 1800), or combinations thereof. The grommet can be fixed in the closed loop 1800 or can rotate compared to the closed loop 1800 with respect to an axis passing through and perpendicular to a plane of the opening in the closed loop 1800.

FIG. 23 illustrates that the grommet 2200 can have a recessed grommet track 2202, along the outside circumference of the grommet 2200. The length of the construct 2100 of most or all of the closed loop 1800 can seat in the grommet track 2202. The grommet 2200 can have radially extending or raised grommet sidewalls 2204 on one or both lateral sides of the grommet track 2202

Figure 24:
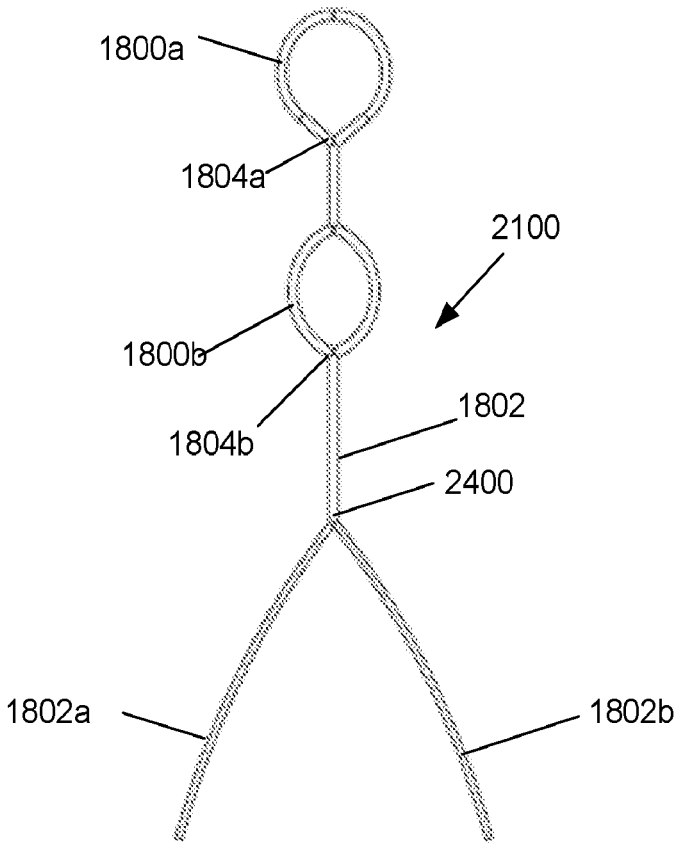
FIGS. 24 through 27 illustrate variations of the braided textile.

FIG. 24 illustrates that the construct 2100 can have a first closed loop 1800*a* at the terminal distal end of the construct 2100. The construct 2100 can have a second closed loop 2800*b* spaced longitudinally at a distance from a first bifurcation end point 1804*a* with a length of a single braid of the construct with yarns that can be continuously extending from the first closed loop 1800*a* to and through the second closed loop 1800*b*. Proximal to the second bifurcation point 1804*b* of the second closed loop 2800*b*, the single braid tail 1802 can split at a tail split point 2400 into a first tail 1802*a* and a second tail 1802*b*. The first and second tails 1802*a* and 1802*b* can each have half the yarns continuously extending from the single braid tail 1802. The first and second tails 1802*a* and 1802*b* can be made using the method to form the closed loops 1800, but instead of moving the bifurcation bar 104 into an open configuration after the splitting of the tail 1802, the proximal terminal ends of the first and second tails 1802*a* and 1802*b* can be shear cut from the braiding machine.

Figure 25:
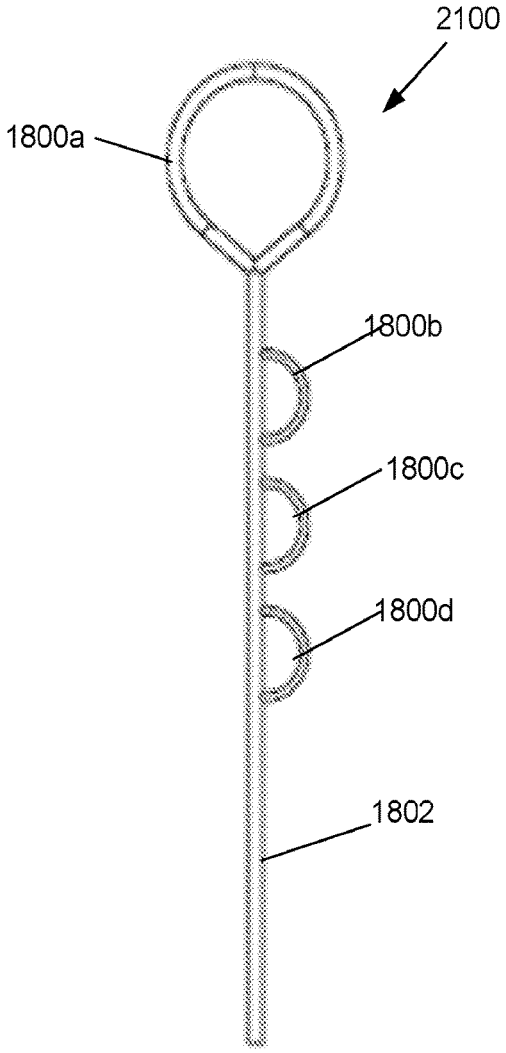

FIG. 25 illustrates that the construct 2100 can have additional closed loops 1800 between the first closed loop 1800*a* at the distal terminal end of the construct 2100 and the tail 1802 or proximal terminal end of the construct, such as the second through fourth closed loops 1800*b*-1800*d*. Some or all of the closed loops 1800 can have semicircular shapes, such as the second through fourth closed loops 1800*b*-1800*d*. The semicircular closed loops can be formed by running the horngears 103 in a first portion 113 of the braiding machine 100 at a faster speed than the horngears 103 in a second portion 115 of the braiding machine 100 when the bifurcation bar 104 is in a closed or obstructing configuration.

Figure 26:
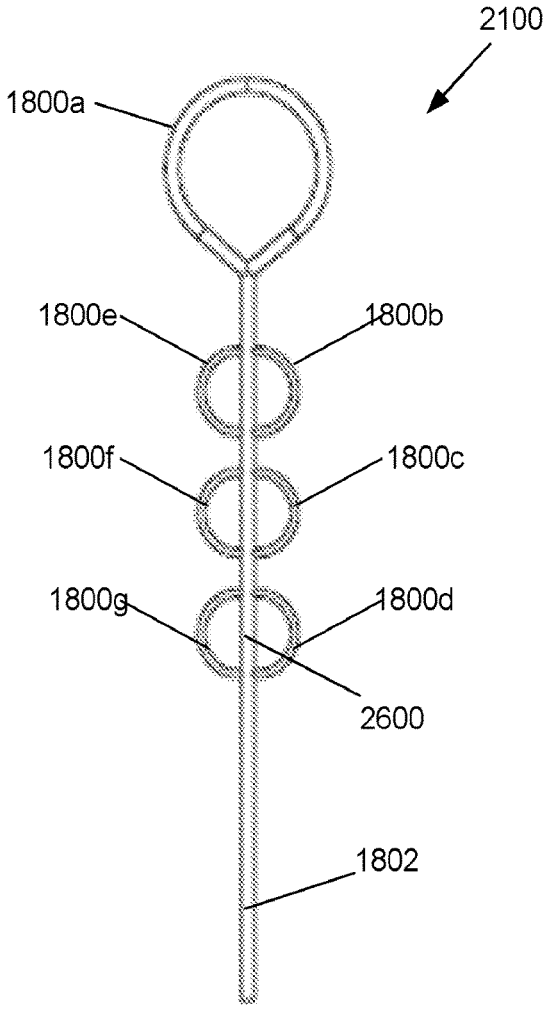
Figure 27:
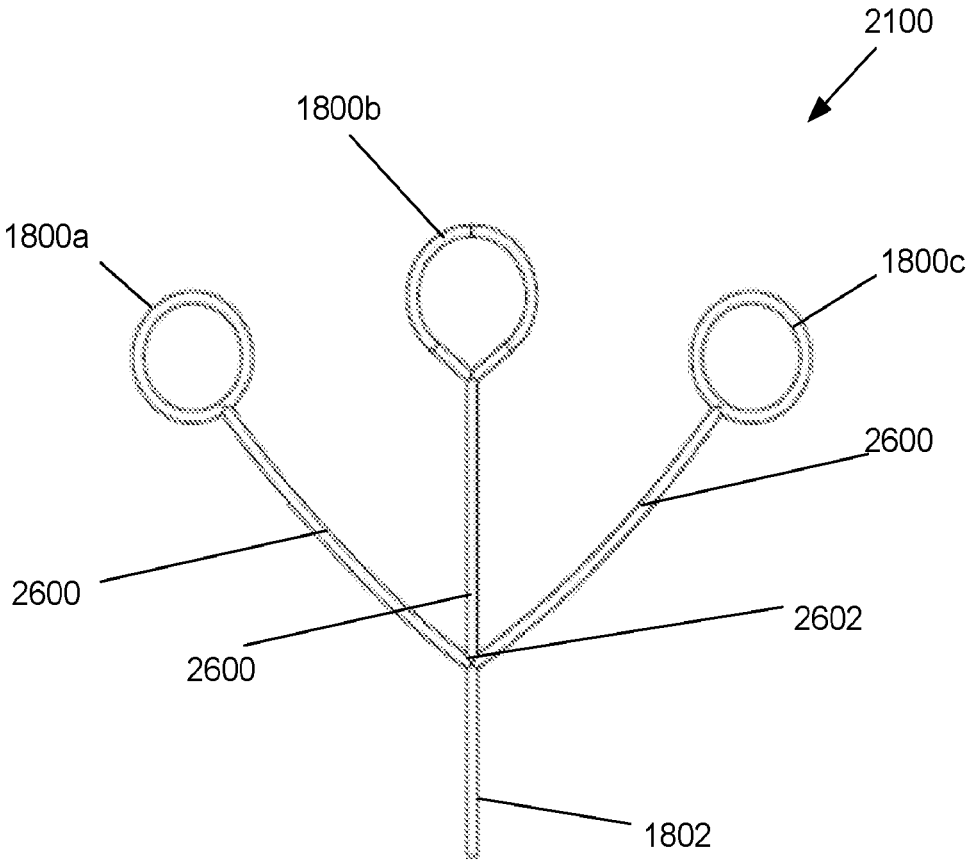

FIG. 26 illustrates that the construct 2100 can have two or more closed loops 1800 extending laterally from a intermediate length or loop bridge 2600 of the construct. The closed loops 1800 can extend from the loop bridges 2600 in pairs symmetric with respect to the longitudinal axis of the construct. For example, the second closed loop 1800*b* can extend angularly or diametrically opposite from the fifth closed loop 1800*e* with respect to the loop bridge 2600. The pair of closed loops 1800 can be at the same, overlapping, or non-overlapping longitudinal lengths along the construct 2100. The construct 2100 can have three pairs of closed loops 1800 extending from the loop bridges 2600, such as the second and fifth loops 1800*b* and 1800*e*, the third and sixth loops 1800*c* and 1800 *f*, and the fourth and seventh loops 1800*d* and 1800*g*. This construct 2100 can be made using the method disclosed herein and by splitting the braider 100 into three portions with bifurcation bars 104, and operating the horngears 104 in two of the portions at a faster speed than the third portion. The yarns in the single braid lengths of the construct 2100 can extend continuously through the closed loops and loop bridges FIG. 27 illustrates that the construct 2100 can have closed loops 1800*a*-1800*c* than can each extend from a separate braid neck 2600. The braid necks 2600 can converge into a single (as shown) or multiple neck convergence points 2602. The yarns in the tail can extend continuously through the necks 2600 and closed loops 1800.

The braid may be made of yarn, such as natural materials such as silk and cotton, synthetic materials such as polymers, for example polyethylene, polyethylene terephthalate (PET), ultra high molecular weight polyethylene (UHMWPE), polytetrafluoroethylene (PTFE), or other biocompatible polymer, biologically incompatible yarn such as cotton, metal (e.g., gold, platinum, nickel, tin, nitinol, cobalt, chromium, stainless steel), polyester, nitinol, polypropylene, or combinations thereof.

The resulting prosthetic braided textile may be coated or otherwise treated with a suitable biocompatible material to permit enhanced acceptance by and use in the body. The yarns may be resorbable, nonabsorbable, or a combination thereof.

The braided textile may be braided to be a length generally known for use with medical devices or implantation in an adult or infant human. The braid at the proximal end may have the same diameter or a different diameter than the braid on the closed loop. The braided textile may be any shape and braided according to any known pattern for making a braided textile, for example round, flat, or combinations thereof. The braid may be braided with a marker, such as a colored yarn, braided therethrough. One or more of the yarns may be a different material or yarn than the remainder of the yarns.

The braided textile may have more than one closed loop at the distal end. For example, two, three, four, five or more closed loops may be individually braided at the distal end and then all braided together to form the tail of the braided textile.

The braided textile can be made without burying the knots within the construct (i.e., the braided textile itself). The braided textile can have a consistent strength through the entire structure, such as throughout the length of the textile from the loop to the tail. The tensile strength of each end of the loop can be about 50% of the tensile strength of the tail. The loop can have symmetric geometry about a longitudinal bisecting plane 1900. For example, the textile can have a substantially constant tensile strength in the loop section of the textile.

Braids can be made on any conventional braiding machines that can be purchased from a supplier, such as Herzog, Ratera and HC Machines. Any of these machines can be used as a starting platform for a custom machine to make the braided textiles disclosed herein. A standard maypole braiding machine can allow individual carriers, individual yarn shuttles, to radially wrap yarns in both the clockwise and counterclockwise direction. The yarns in the final braided product can be braided together as the carriers on the braiding machine are on crossing elliptical paths. The paths of the yarn carriers can be manipulated during the braiding process. The carrier paths can be guided by using diverters within the base plate that are controlled by a computer. The braiding machine carriers follow one of two paths to make each part of the braided textile. That is, a standard maypole braiding configuration to make the single braided braid of the tail section, and a bifurcation braiding configuration to braid the closed loop. The proposed custom designed braiding machine would allow the operator to switch back and forth between standard maypole and bifurcation configuration. The operator can adjust input values into the human machine interface (HMI) on the braiding machine that would allow for precise control over the diameter of the closed loop and the length of the tail. The braiding disclosed herein can be maypole braiding, non-maypole braiding, or combinations thereof. The resulting braided textile suture or construct can have no shear cut ends except at the terminal end of the tail away from the closed loop.

Elements of the apparatuses and methods disclosed in U.S. Pat. Nos. 7,908,956, 8,347,772, and 8,943,941, which are incorporated by reference herein in their entireties, can be used in combination with any of the apparatuses and methods disclosed herein. The suture leader 1004 can be formed into a flat tape. The term "bifurcation" as used herein can refer to true bifurcation and/or production of two separate maypole braids adjacent to each other (e.g., and then optionally coalescing the two braids back into a single construct or braid).

Any elements described herein as singular can be pluralized (i.e., anything described as "one" can be more than one). Any species element of a genus element can have the characteristics or elements of any other species element of that genus. The above-described configurations, elements or complete assemblies and methods and their elements for carrying out the disclosure, and variations of aspects of the disclosure can be combined and modified with each other in any combination.

We claim:

1. A braided construct, comprising:

a) a plurality of yarns comprising a first portion of the plurality of yarns that is braided to form a first side of a first closed loop and a second portion of the plurality of yarns that is braided to form a second side of the first closed loop, b) wherein the braided first and second portions of the plurality of yarns converge at a first convergence point where they are braided together into a single braid forming a first tail, and c) wherein the plurality of yarns continuously extends from the first tail into the first convergence point and then the first side of the first closed loop, through the second side of the first closed loop and back to the convergence point and into the first tail.

2. The braided construct of claim 1, wherein the plurality of yarns is selected from the group of silk, cotton, polyethylene, polypropylene, polyethylene terephthalate (PET), ultra-high molecular weight polyethylene (UHMWPE), polytetrafluoroethylene (PTFE), polyester, gold, platinum, nickel, tin, nitinol, cobalt, chromium, stainless steel, and combinations thereof.

3. The braided construct of claim 1, wherein the single braid comprising the first tail is a single maypole braid of the plurality of yarns.

4. The braided construct of claim 1, wherein, except at a terminal end of the first tail, the plurality of yarns comprising the first tail does not have any shear cut ends.

5. The braided construct of claim 1, wherein more than half of the plurality of yarns in the first closed loop extend into the single braid forming the first tail.

6. The suture of claim 1, wherein the plurality of yarns comprise nitinol.

7. The braided construct of claim 1, wherein a reinforcement grommet resides in the first closed loop.

8. The braided construct of claim 7, wherein the reinforcement grommet has at least one of the following characteristics:

a) is fixed or rotatable with respect to the first closed loop;
b) is rigid or flexible;
c) is elastic and resilient;
d) is coated with polytetrafluoroethylene (PTFE) as a friction reducing material;
e) has a shape selected from the group of circular, oval, octagonal, square, rectangular, triangular, teardrop-shaped, and combinations thereof;
f) is fixed with respect to the first closed loop; and
g) is rotatable in the first closed loop with respect to an axis passing through and perpendicular to a plane of an opening in the first closed loop.

9. The braided construct of claim 1, wherein the braided plurality of yarns in the first tail diverge at a divergence point where the first portion of the plurality of yarns forms a third side of a second closed loop and the second portion of the plurality of yarns forms a fourth side of the second closed loop, and wherein the braided first and second portions of the plurality of yarns converge at a second convergence point where they form a single braid serving as a second tail.

10. The braided construct of claim 9, wherein the third side of the second closed loop extends along a longitudinal axis.

11. The braided construct of claim 9, wherein spaced from the second convergence point, the second tail splits into a second tail first portion and a second tail second portion.

12. The braided construct of claim 1, wherein the braided first and second portions of the plurality of yarns in the first tail diverge at a divergence point to form a loop bridge and a third side of a second closed loop and a fourth side of the second closed loop, and wherein the loop bridge and the plurality of yarns comprising the third and fourth sides of the second closed loop converge at a second convergence point where they form a single braid serving as a second tail.

13. The braided construct of claim 1, wherein the first and second portions of the plurality of yarns are braided in the respective first and second sides of the closed loop in a configuration selected from the group of a 1-over-1 configuration, a 1-over-2-by-2, a 1-over-2 configuration, and a 2-over-2 configuration.

14. A braided construct, comprising:

a) a plurality of yarns comprising a first portion of the plurality of yarns that is braided to form a first side of a first closed loop and a second portion of the plurality of yarns that is braided to form a second side of the first closed loop, wherein the braided first and second portions of the plurality of yarns converge at a convergence point where they are braided together into a single braid forming a first tail, and
b) wherein the plurality of yarns continuously extends from the first tail into the first convergence point and then the first side of the first closed loop, through the second side of the first closed loop and back to the convergence point and into the first tail, and
c) wherein the first and second portions of the plurality of yarns are braided in the respective first and second sides of the closed loop in a configuration selected from the group of a 1-over-1 configuration, a 1-over-2-by-2, a 1-over-2 configuration, and a 2-over-2 configuration,
d) wherein the braided plurality of yarns in the first tail diverge at a divergence point where a third portion of the plurality of yarns is braided to form a third side of a second closed loop and a fourth portion of the plurality of yarns is braided to form a fourth side of the second closed loop, and wherein the braided third and fourth portions of the plurality of yarns converge at a second convergence point where they form a single braid serving as a second tail.

15. The braided construct of claim 14, wherein spaced from the second convergence point, the second tail splits into a second tail first portion and a second tail second portion.

16. The braided construct of claim 14, wherein the plurality of yarns is selected from the group of silk, cotton, polyethylene, polypropylene, polyethylene terephthalate (PET), ultra-high molecular weight polyethylene (UHMWPE), polytetrafluoroethylene (PTFE), polyester, gold, platinum, nickel, tin, nitinol, cobalt, chromium, stainless steel, and combinations thereof.

17. A braided construct, comprising:

a) a plurality of yarns comprising a first portion and a second portion, wherein the first portion of the plurality of yarns is braided to form a first side of a first closed loop and the second portion of the plurality of yarns is braided to form a second side of the first closed loop, and wherein the braided first and second portions of the plurality of yarns converge at a convergence point where they are braided together into a single braid forming a first tail, and
b) wherein the braided plurality of yarns in the first tail diverge at a divergence point where a third portion of the plurality of yarns is braided to form a third side of a second closed loop, a fourth portion of the plurality of yarns is braided to form a fourth side of the second closed loop, and a fifth portion of the plurality of yarns is braided to form a loop bridge, and wherein the braided yarns in the third and fourth sides of the second closed loop and in the loop bridge converge at a second convergence point where they form a single braid forming a second tail.

18. The braided construct of claim 17, wherein the plurality of yarns is selected from the group of silk, cotton, polyethylene, polypropylene, polyethylene terephthalate (PET), ultra-high molecular weight polyethylene (UHMWPE), polytetrafluoroethylene (PTFE), polyester, gold, platinum, nickel, tin, nitinol, cobalt, chromium, stainless steel, and combinations thereof.

* * * * *